US010681488B1

(12) United States Patent
Liang

(10) Patent No.: US 10,681,488 B1
(45) Date of Patent: Jun. 9, 2020

(54) SOUND PRODUCING APPARATUS AND SOUND PRODUCING SYSTEM

(71) Applicant: xMEMS Labs, Inc., Los Altos, CA (US)

(72) Inventor: Jemm Yue Liang, Sunnyvale, CA (US)

(73) Assignee: xMEMS Labs, Inc., Los Altos, CA (US)

( * ) Notice: Subject to any disclaimer, the term of this patent is extended or adjusted under 35 U.S.C. 154(b) by 0 days.

(21) Appl. No.: 16/551,685

(22) Filed: Aug. 26, 2019

Related U.S. Application Data

(60) Provisional application No. 62/813,075, filed on Mar. 3, 2019, provisional application No. 62/828,483, filed on Apr. 3, 2019.

(51) Int. Cl.

| | |
|---|---|
| ***H04S 7/00*** | (2006.01) |
| ***H04R 5/02*** | (2006.01) |
| ***H04R 1/34*** | (2006.01) |
| ***H04S 3/00*** | (2006.01) |
| ***H04R 5/04*** | (2006.01) |

(52) U.S. Cl.
CPC ..... *H04S 7/303* (2013.01); *H04R 1/345* (2013.01); *H04R 5/02* (2013.01); *H04R 5/04* (2013.01); *H04S 3/008* (2013.01); *H04S 2400/01* (2013.01)

(58) Field of Classification Search
CPC ..... H04S 7/303; H04S 3/008; H04S 2400/01; H04R 5/02; H04R 5/04; H04R 1/345; H04R 3/04; H04R 1/1083; H04R 2225/55; H04R 1/1016; H04R 25/505; H04R 25/554; H04R 2499/11; H04R 25/558; H04R 25/70; H04R 2430/01; H04R 3/005; H04R 1/1008; H04R 1/1041; H04R 1/323
See application file for complete search history.

(56) References Cited

U.S. PATENT DOCUMENTS

| | | | | |
|---|---|---|---|---|
| 4,515,997 | A | 5/1985 | Stinger, Jr. | |
| 6,807,281 | B1 | 10/2004 | Sasaki | |
| 6,965,676 | B1 * | 11/2005 | Allred | H03G 5/005 361/107 |
| 7,019,955 | B2 * | 3/2006 | Loeb | H04R 17/00 361/230 |
| 7,146,011 | B2 | 12/2006 | Yang | |
| 7,596,228 | B2 | 9/2009 | Pompei | |

(Continued)

FOREIGN PATENT DOCUMENTS

| | | | |
|---|---|---|---|
| EP | 1 122 973 | A2 | 8/2001 |
| WO | 2011/117903 | A2 | 9/2011 |

(Continued)

*Primary Examiner* — Akelaw Teshale
(74) *Attorney, Agent, or Firm* — Winston Hsu

(57) ABSTRACT

A sound producing apparatus is provided. The sound producing apparatus includes a sound producing device disposed at a sound producing location and configured to produce a plurality of air pulses according to a driving signal; a driving circuit, receiving an input audio signal and a channel-shaping signal and configured to generate the driving signal according to the input audio signal and the channel-shaping signal, wherein the channel-shaping signal is related to a channel impulse response of a channel between the sound producing location and a sound constructing location; a signal processing circuit, configured to generate the channel-shaping signal according to the channel impulse response.

29 Claims, 18 Drawing Sheets

(56) References Cited

U.S. PATENT DOCUMENTS

| | | | | |
|---|---|---|---|---|
| 8,594,350 | B2 | 11/2013 | Hooley | |
| 8,867,313 | B1 * | 10/2014 | Rivlin | G01S 11/14 367/118 |
| 2001/0043652 | A1 * | 11/2001 | Hooley | H03K 7/08 375/238 |
| 2006/0050897 | A1 | 3/2006 | Asada | |
| 2007/0211574 | A1 | 9/2007 | Croft, III | |
| 2013/0044904 | A1 * | 2/2013 | Margalit | H04R 17/00 381/182 |
| 2013/0093578 | A1 * | 4/2013 | Goto | G10K 9/122 340/425.5 |
| 2017/0180855 | A1 | 6/2017 | Lee | |
| 2017/0201192 | A1 * | 7/2017 | Tumpold | H01L 41/081 |

FOREIGN PATENT DOCUMENTS

| | | | |
|---|---|---|---|
| WO | 2011/117903 | A3 | 1/2012 |
| WO | 2011/117903 | A4 | 3/2013 |

* cited by examiner

SOUND PRODUCING APPARATUS AND SOUND PRODUCING SYSTEM

CROSS REFERENCE TO RELATED APPLICATIONS

This application claims the benefit of U.S. provisional application No. 62/813,075, filed on Mar. 3, 2019 and U.S. provisional application No. 62/828,483, filed on Apr. 3, 2019, which are all incorporated herein by reference.

BACKGROUND OF THE INVENTION

1. Field of the Invention

The present application relates to a sound producing apparatus and a sound producing system, and more particularly, to a sound producing apparatus and a sound producing system capable of leveraging the multipath effect and constructing audio sound at location which is a distance away from sound producing device.

2. Description of the Prior Art

Speaker driver is always the most difficult challenge for high-fidelity sound reproduction in the speaker industry. The physics of sound wave propagation teaches that, within the human audible frequency range, the sound pressures generated by accelerating a membrane of a conventional speaker driver may be expressed as $P \propto SF \cdot AR$, where SF is the membrane surface area and AR is the acceleration of the membrane. Namely, the sound pressure P is proportional to the product of the membrane surface area SF and the acceleration of the membrane AR. In addition, the membrane displacement DP may be expressed as $DP \propto 1/2 \cdot AR \cdot T^2 \propto 1/f^2$, where T and f are the period and the frequency of the sound wave respectively. The air volume movement $V_{A,CV}$ caused by the conventional speaker driver may then be expressed as $V_{A,CV} \propto SF \cdot DP$. For a specific speaker driver, where the membrane surface area is constant, the air movement $V_{A,CV}$ is proportional to $1/f^2$, i.e., $V_{A,CV} \propto 1/f^2$.

To cover a full range of human audible frequency, e.g., from 20 Hz to 20 KHz, tweeter(s), mid-range driver(s) and woofer(s) have to be incorporated within a conventional speaker. All these additional components would occupy large space of the conventional speaker and will also raise its production cost. Hence, one of the design challenges for the conventional speaker is the impossibility to use a single driver to cover the full range of human audible frequency.

Another design challenge for producing high-fidelity sound by the conventional speaker is its enclosure. The speaker enclosure is often used to contain the back-radiating wave of the produced sound to avoid cancellation of the front radiating wave in certain frequencies where the corresponding wavelengths of the sound are significantly larger than the speaker dimensions. The speaker enclosure can also be used to help improve, or reshape, the low-frequency response, for example, in a bass-reflex (ported box) type enclosure where the resulting port resonance is used to invert the phase of back-radiating wave and achieves an in-phase adding effect with the front-radiating wave around the port-chamber resonance frequency. On the other hand, in an acoustic suspension (closed box) type enclosure, the enclosure functions as a spring which forms a resonance circuit with the vibrating membrane. With properly selected speaker driver and enclosure parameters, the combined enclosure-driver resonance peaking can be leveraged to boost the output of sound around the resonance frequency and therefore improve the performance of resulting speaker.

To overcome the design challenges of speaker driver and enclosure within the sound producing industry, a PAM-UPA sound producing scheme has been proposed. However, the PAM-UPA sound producing scheme does not take "multipath effect" into consideration. Firstly, in the PAM-UPA scheme, an enclosure is still required to contain the back radiating wave. Such containment not only increase the size of the speaker but also wasted half of the energy produced by the sound production device. Secondly, the PAM-UPA sound producing scheme, like all conventional speakers, produces sound at the surface of the sound producing device which is generally at a distance away from listening positions, and therefore requires high SPL at the surface of sound producing device in order to produce sufficient SPL at the listening positions.

Therefore, it is necessary to improve the prior art.

SUMMARY OF THE INVENTION

It is therefore a primary objective of the present application to provide a sound producing apparatus and a sound producing system capable of leveraging the multipath effect and constructing audio sound at location which is a distance away from sound producing device.

An embodiment of the present application provides a sound producing apparatus, comprising a sound producing device, disposed at a sound producing location, configured to produce a plurality of air pulses according to a driving signal; a driving circuit, receiving an input audio signal and a channel-shaping signal, configured to generate the driving signal according to the input audio signal and the channel-shaping signal, wherein the channel-shaping signal is related to a channel impulse response of a channel between the sound producing location and a sound constructing location; a signal processing circuit, configured to generate the channel-shaping signal according to the channel impulse response; wherein an air pulse rate of the plurality of air pulses is higher than a maximum human audible frequency; wherein the plurality of air pulses produces a non-zero offset in terms of sound pressure level, and the non-zero offset is a deviation from a zero sound pressure level.

An embodiment of the present application provides a sound producing system, comprising a sound producing apparatus, comprising a sound producing device, disposed at a sound producing location, configured to produce a plurality of air pulses according to a driving signal; a driving circuit, receiving an input audio signal and a channel-shaping signal, configured to generate the driving signal according to the input audio signal and the channel-shaping signal, wherein the channel-shaping signal is related to a channel impulse response of a channel between the sound producing location and a sound constructing location; a signal processing circuit, configured to generate the channel-shaping signal according to the channel impulse response; a sounding circuit, configured to generate the channel impulse response of the channel between the sound producing location and the sound constructing location; wherein an air pulse rate of the plurality of air pulses is higher than a maximum human audible frequency; wherein the plurality of air pulses produces a non-zero offset in terms of sound pressure level, and the non-zero offset is a deviation from a zero sound pressure level.

These and other objectives of the present application will no doubt become obvious to those of ordinary skill in the art after reading the following detailed description of the preferred embodiment that is illustrated in the various figures and drawings.

DETAILED DESCRIPTION

Figure 1:
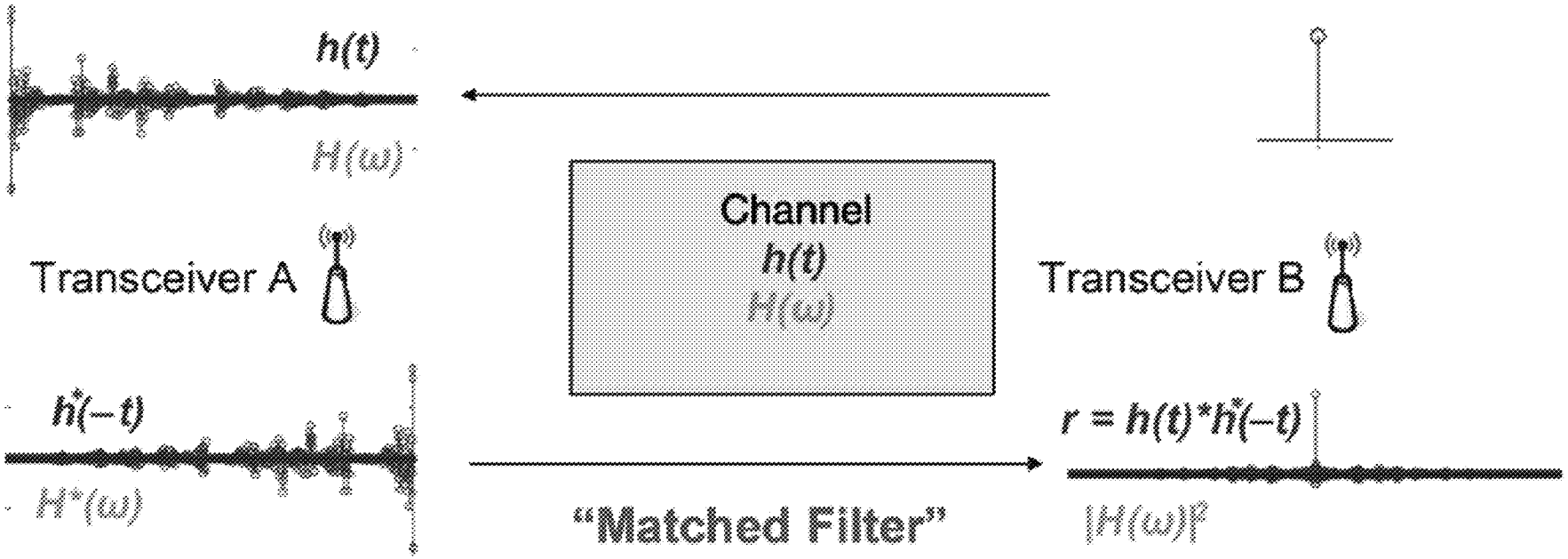
FIG. 1 is a schematic diagram of a time-reversal signal transmission scheme.

It is desirable to enhance the PAM-UPA sound producing scheme such that the resulting apparatus or system will utilize the multipath of the ambient environment to reconstruct audible sound directly at locations close to listeners' ears. In doing so, due to the much-shortened distance between sound reconstruction points and the ears, the generated sound pressure level (SPL) can be reduced drastically.

In addition, in this multipath enhanced PAM-UPA scheme, the back-radiating wave may be treated as just one of the multipath and, therefore, may be utilized to reconstruct audible sound. In doing so, the resulting sound producing apparatus or system will not only increase the sound producing efficiency but will also do away with the need for enclosures to contain back-radiating sound waves.

In the present application, a signal a or an impulse response b can be interchangeably expressed in continuous-time function a(t) or b(t) of time t. The term "coupled" in the present application is referred to either a direct or an indirect connection means. Further, the term "coupled" in the present application may refer to either a wireless connection means or a wireline connection means. For example, "a first circuit is coupled to a second circuit" may refer that "the first circuit is connected to the second circuit via a wireless connection means", or "the first circuit is connected to the second circuit via a wireline connection means".

To overcome the design challenges of speaker driver and enclosure within the sound producing industry, Applicant provides the sound producing MEMS (micro-electrical-mechanical-system) device in U.S. application Ser. No. 16/125,761, so as to produce sound in an air pulse rate/frequency, where the air pulse rate is higher than the maximum (human) audible frequency.

The sound producing device in U.S. application Ser. No. 16/125,761 requires valves and membrane to produce the air pulses. To achieve such fast pulse rate, the valves need to be able to perform open-and-close operation at an ultrasound frequency, e.g., 40 KHz. The fast moving valves would need to endure dust, sweat, hand grease, ear wax, and be expected to survive over trillion cycles of operation, which is a challenging problem.

To bypass the high speed movement of valves, Applicant provides a force-based sound producing apparatus/device and a position-based sound producing apparatus/device in U.S. application Ser. Nos. 16/420,141 and 16/420,190. In the force-based sound producing apparatus, an conventional speaker based on electromagnetic force or electrostatic force, e.g., a treble speaker or a tweeter, is utilized as a sound producing device (SPD), and the force-based SPD is directly driven by a pulse amplitude modulated (PAM) driving signal. In the position-based apparatus, a MEMS SPD is utilized and a summing module therein is utilized to convert the PAM driving signal to the driving voltage to drive the membrane within the MEMS SPD to achieve a certain position.

Application Ser. Nos. 16/420,141 and 16/420,190 take advantage of the characteristics of the PAM sound producing devices as discussed in U.S. application Ser. No. 16/125,761. First, amplitudes of pulses within the plurality of air pulses determine, independently from the frequency of the envelope of the pluralities of air pulses, the SPL of the audible sound produced by PAM sound producing devices. Second, under a given SPL, the relationship between a net membrane displacement DP and frequency of the audible sound f is $$DP \propto \frac{1}{f}$$

of PAM sound producing devices, instead of $$DP \propto \frac{1}{f^2}$$

of the conventional speaker drivers.

The PAM•UPA schemes of the U.S. application Ser. Nos. 16/125,761, 16/420,141 and 16/420,190 all implicitly assumed that the envelope of audible sound is reconstructed right in front of the SPD. In fact, the listener is usually a distance away from the SPD, and the plurality of air pulses generated by SPD would experience (or propagate through) multipath channels. Thereby, that implicit assumption is only a special case of a more generalized PAM-UPA scheme: the audible sound envelope is constructed at a certain location by a plurality of air pressure pulses where the rate of the pressure pulse is at a rate higher than human audible frequency and the said certain location is within the ambient environment of the intended listener.

Note that, multipath comprises multitude of channel-paths and the inter-channel-path interference termed in the present application is known as the inter symbol interference (ISI) in the field of communication system. For some communication systems, e.g., OFDM systems, transmitted symbol duration is usually larger than channel propagation delay, and thereby signal component carried by channel path with long propagation delay would interfere the consecutive symbol, which is termed as ISI. Different from those communication systems, in PAM•UPA schemes of U.S. application Ser. Nos. 16/125,761, 16/420,141 and 16/420,190, the pulse cycle $T_{cycle}$ is much shorter than the channel propagation delay, and air pulses passing through the shorter (or shortest) channel-paths will interfere with the air pulses passing through the longer (or longest) channel-paths, which is termed as inter channel-path interference (ICI). It is the objective of the present application to take advantage of such ICI between different channel-paths within the ambient of the intended listener constructively such that the envelope of audible sound is reconstructed at locations close to the listeners.

Recently, time-reversal (TR) signal transmissions in the field of communication system, acoustic system or medical ultrasonic device are developed. Take TR communication systems for example, the TR signal transmission can fully harvest signal energy from the surrounding multipath environment by exploiting the multipath propagation. The TR signal transmission communication system can be illustrated in FIG. 1, quoted from C. Chen et al., "Achieving centimeter-accuracy indoor localization on Wi-Fi platforms: a multi-antenna approach", *IEEE IoT Journal*, vol. 4, no. 1, February 2017 (abbreviated as [1] hereafter). Before a transceiver A intends to transmit information to a transceiver B, in a first channel probing phase, the transceiver B may transmit a probing signal to the transceiver A. The transceiver A would extract a channel impulse response (CIR) h(t), e.g., via a sounding operation, take time-reversal and conjugate on the CIR, to generate a signature or a channel shaping signal g(t) to be $g(t)=h^*(-t)$. In a second phase, termed as a transmission phase, the transceiver A convolutes the transmitted symbol with the signature or the channel shaping signal g(t) and send the convolution result to transceiver B. Due to the reciprocity of the channel, the TR waves sent by the transceiver A would retrace the incoming paths and end up with a spiky (or impulsive) signal-power distribution focused at the intended location, as illustrated in bottom-right corner of FIG. 1. Through the time-reversal $g(t)=h^*(-t)$ and the CIR h(t), the CIR h(t) is regarded as being autocorrelated and the result would be an impulsive peak observe at the location of the transceiver B. From perspective of communication and signal processing, the channel with CIR h(t) acts as a matched filter and the signature g(t) actually shapes the equivalent channel $g(t)\otimes h(t)$ to have spiky response, temporally and spatially, (and that's why g(t) is called channel shaping signal), where $\otimes$ denotes the linear convolution operation. Details of TR technology can be referred to [1] and M. Fink, "Time-reversed acoustic," *Scientific American*, 1999.

The basic operation of the present invention consists of replacing the transceiver B with UPA generating SPD and replacing transceiver A, which may be near the ear of listener, with a suitable ultrasound recording device. The recording device A will record channel impulse response corresponding to an ultrasonic pulse transmitted from the SPD (device B), a signal processing operation (e.g., a time reversing operation) is performed on this response to obtain $h^*(-t)$, and then convolute $h^*(-t)$ with sound source signal to produce driving signals to drive UPA generating SPD. The UPA thus generated will be autocorrelated with the channel between A and B and result in PAM•UPA waveform being constructed at a location of the device A (abbreviated as location A). This PAM•UPA waveform will in turn produce audible sound which radiates outward from location A omnidirectionally. In short, in the present application, the reconstruction of audible sound envelope is achieved through TR signal transmission technique which leverages the multipath channel as a matched filter and PAM•UPA waveform is reconstructed at location A without any receiver-end filter.

Figure 2:
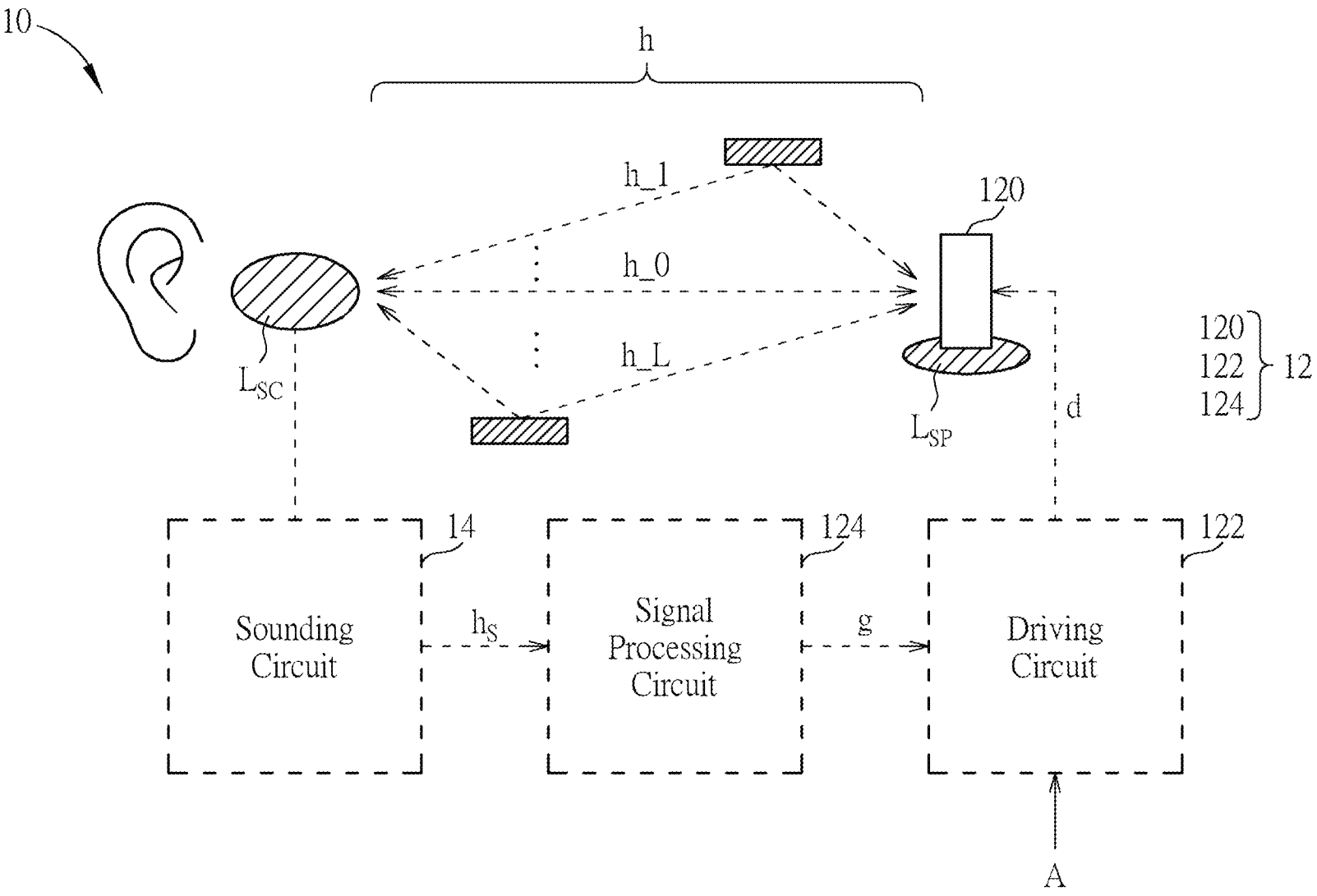
FIG. 2 is a schematic diagram of a sound producing system according to an embodiment of the present application.

FIG. 2 is a schematic diagram of a sound producing system 10 according to an embodiment of the present application. The sound producing system 10 may, but not limited to, be disposed within a walled-in environment, e.g., an office, a living room, an exhibition hall, or inside a vehicle. The sound producing system 10 comprises a sound producing apparatus 12 and a sounding circuit 14, during a transmission phase. The sound producing apparatus 12 comprises a sound producing device (SPD) 120, a driving circuit 122 and a signal processing circuit 124. The SPD 120 is disposed at a sound producing location $L_{SP}$. The SPD 120 is configured to produce a plurality of air pulses at an air pulse rate according to a driving signal d. The driving circuit 122 receives an input audio signal A and a channel-shaping signal g and is configured to generate the driving signal d according to the input audio signal A and the channel-shaping signal g.

The sounding circuit 14 is configured to perform a sounding operation with respect to a channel h between a sound producing location $L_{SP}$ and a sound constructing location $L_{SC}$, so as to generate an estimated channel impulse response $h_S$ corresponding to the channel h. The sound producing location $L_{SP}$ is the location at which the SPD 120 locates, and the sound constructing location $L_{SC}$ is the location at which an audio sound is constructed, preferably near the ears of a listener.

The multipath channel h, between the sound producing location $L_{SP}$ and the sound constructing location $L_{SC}$, may comprise channel paths h_0, . . . , h_L and the channel impulse response h(t) is mathematically expressed as $h(t)=\Sigma_k\ h_k\cdot\delta(t-\tau_k)$, where $\tau_k$ represents a sound wave propagation delay corresponding to the kth channel path h_k between sound producing location $L_{SP}$ and sound constructing location $L_{SC}$. The sounding circuit 14 may, or may not, obtain the channel impulse response $h_S(t)$ during a probing/recording phase.

The signal processing circuit 124 is configured to perform a signal processing operation, e.g., a time reversing operation, on the estimated CIR $h_S$ (or $h_S(t)$), so as to generate the channel-shaping signal g. Specifically, the signal processing circuit 124 generates the channel-shaping signal g such that the channel-shaping signal g(t) is proportional to a time-reversed or a time-reversed-and-conjugated counterpart of the estimated CIR $h_S(t)$ of the channel h. That is, the channel-shaping signal g(t) reflects the feature/waveform of $h_S(-t)$ or $h_S^*(-t)$, regardless of translation in time, where ( ) denotes a complex conjugate operation. Practically, the channel-shaping signal g(t) may be expressed as $g(t)=a\cdot h_S(T-t)$ or $g(t)=a\cdot h_S^*(T-t)$, where a is a constant. In an embodiment, T may be greater than or equal to the maximum propagation delay of the channel h, the longest propagation time corresponding to the latest arrived among channel paths h_0, . . . , h_L.

Figure 3:
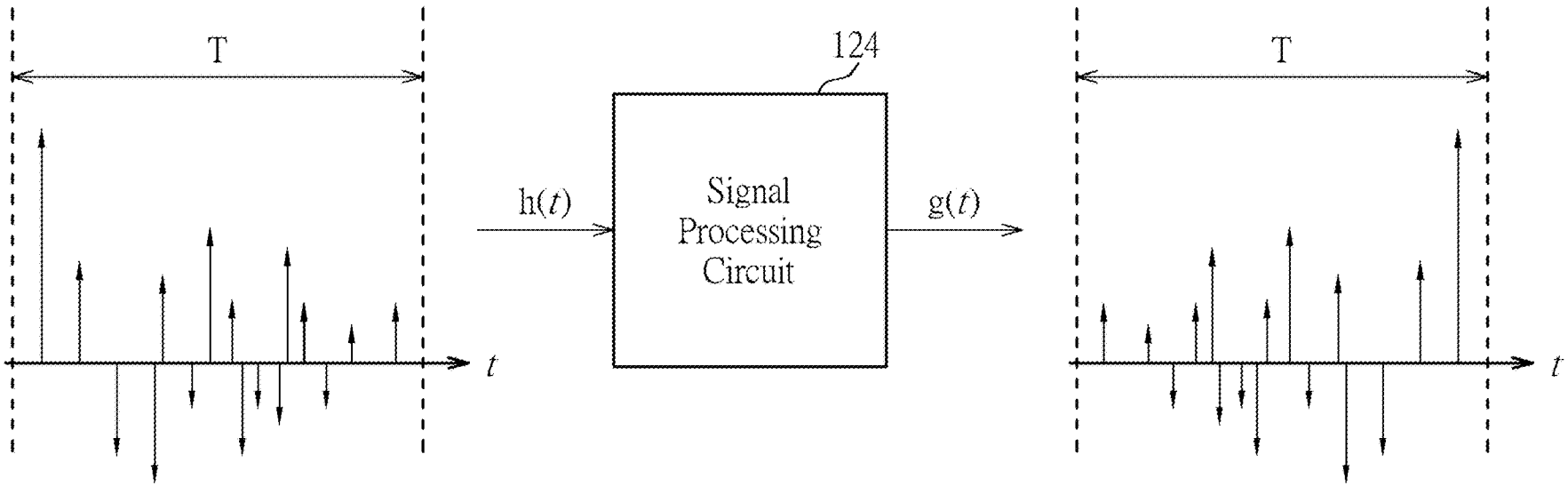
FIG. 3 illustrates waveforms of the channel impulse response and the channel-shaping signal.

FIG. 3 illustrates waveforms of the channel impulse response $h_S(t)$ and the channel-shaping signal g(t). As can be seen from FIG. 3, the signal processing circuit 124 actually performs time-wise mirroring and time-wise translation on the channel impulse response $h_S(t)$, to obtain the channel-shaping signal g(t).

In the sound producing system 10 illustrated in FIG. 2, the SPD 120 is physically disposed at the sound producing location $L_{SP}$, the rest of the circuits, such as the driving circuit 122, the signal processing circuit 124 and the sounding circuit 14, do not have to be disposed at one specific location, which means that the internal circuits of the sound producing system 10 and/or the sound producing device 12 may or may not be disposed at the same location. The internal circuits, including the driving circuit 122, the signal processing circuit 124 and the sounding circuit 14, may be connected via wireline connections or wireless connections. In an embodiment, the driving circuit 122, the signal processing circuit 124 and the sounding circuit 14 may be disposed concentratively by/near the SPD 120, or sparsely over the listening environment. In an embodiment, the driving circuit 122, the signal processing circuit 124 and the sounding circuit 14 may be concentratively contained within a control device in the listening environment.

The plurality of air pulses produced by the SPD 120 is emitted from the sound production location $L_{SP}$, would propagate through the walled-in environment and experience the channel h, such that an SPL envelope corresponding to the input audio signal A(t) would be constructed at the sound construction location $L_{SC}$. In an embodiment, the SPL envelope would be the same as the input audio signal A(t). Note that, the sound production location $L_{SP}$ is different from the sound construction location $L_{SC}$, which means that the sound construction location $L_{SC}$ may be a distance away from the sound production location $L_{SP}$.

In an embodiment, the driving circuit 122 is configured to perform a (linear) convolution operation on the input audio signal A(t) and the channel-shaping signal g(t), so as to generate the driving signal d(t) as $d(t)=A(t)\otimes g(t)$, where $\otimes$ denotes the linear convolution operation and the linear convolution is represented as $A(t)\otimes g(t)=\int A(\tau)\cdot g(t-\tau)d\tau$, which is known by the art.

Figure 4:
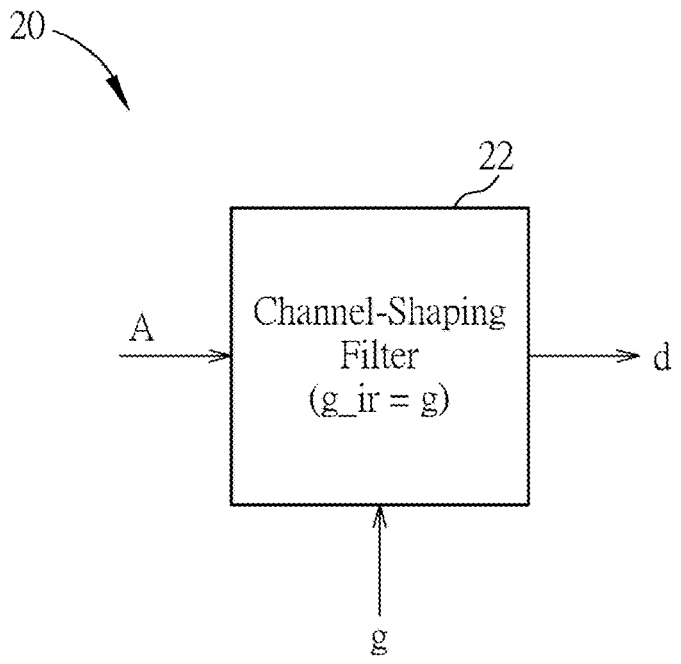
FIG. 4 is a schematic diagram of a driving circuit according to an embodiment of the present application.

FIG. 4 is a schematic diagram of a driving circuit 20 according to an embodiment of the present application. The driving circuit 20 may be used to realize the driving circuit 122. The driving circuit 20 comprises a channel-shaping filter 22, where an impulse response of the channel-shaping filter 22, denoted as g_ir(t), can be dynamically adjusted. Specifically, the impulse response g_ir(t) can be dynamically adjusted to be the channel-shaping signal g(t) generated by the signal processing circuit 124, i.e., g_ir(t)=g(t). Therefore, the channel-shaping filter 22 may output the driving signal d as $d=A\otimes g$, or $d(t)=A(t)\otimes g(t)$. In the digital circuit, the channel-shaping filter 22 may be realized by a database storing digital data of a waveform of the channel-shaping signal g(t).

Figure 5:
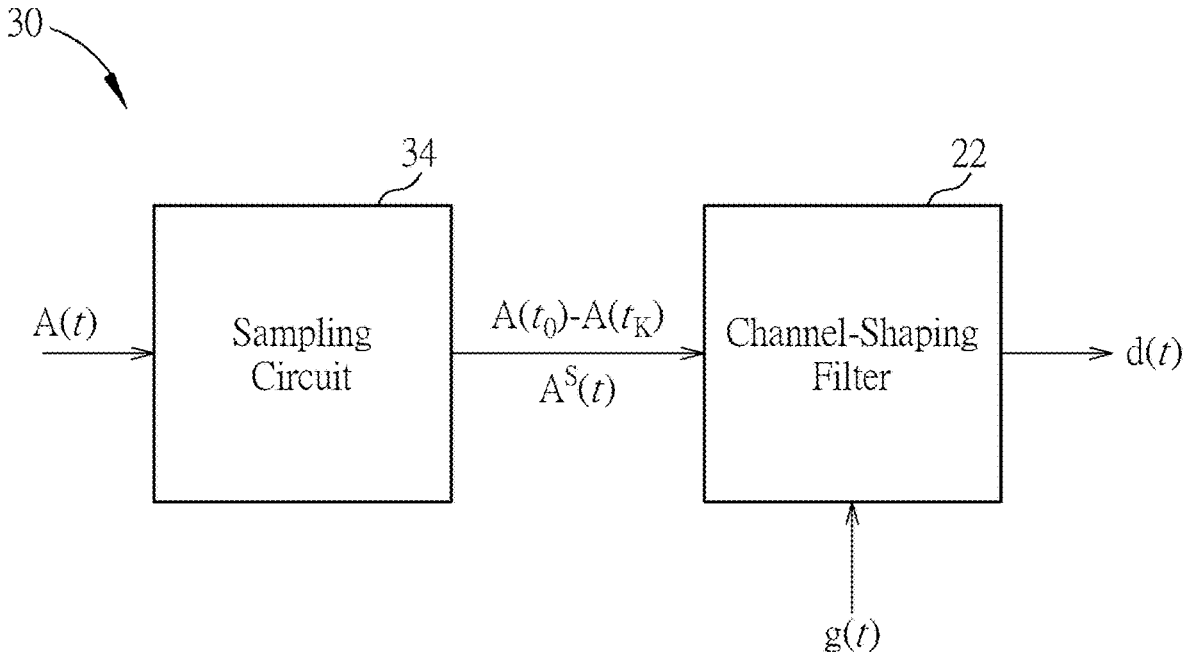
FIG. 5 is a schematic diagram of a driving circuit according to an embodiment of the present application.

FIG. 5 is a schematic diagram of a driving circuit 30 according to an embodiment of the present application. The driving circuit 30 may also be used to realize the driving circuit 122. The driving circuit 30 comprises the channel-shaping filter 22 and a sampling circuit 34. The sampling circuit 34 may perform a sampling operation to generate a plurality of samples $A(t_0)$-$A(t_K)$ of the audio input signal A(t) corresponding to a plurality of sample time instant $t_0$-$t_K$. The samples $A(t_0)$-$A(t_K)$ corresponding to the sample time instant $t_0$-$t_K$ represent a sampled input audio signal $A^S(t)$, expressed as $A^S(t)=\Sigma_k A(t_k)\cdot\delta(t-t_k)$, where $\delta(t)$ represents the Dirac delta function. Given g_ir(t)=g(t), the channel-shaping filter 22 of the driving circuit 30 can produce the driving signal d(t) as $d(t)=\tau_k A(t_k)\cdot g(t-t_k)$.

Figure 6:
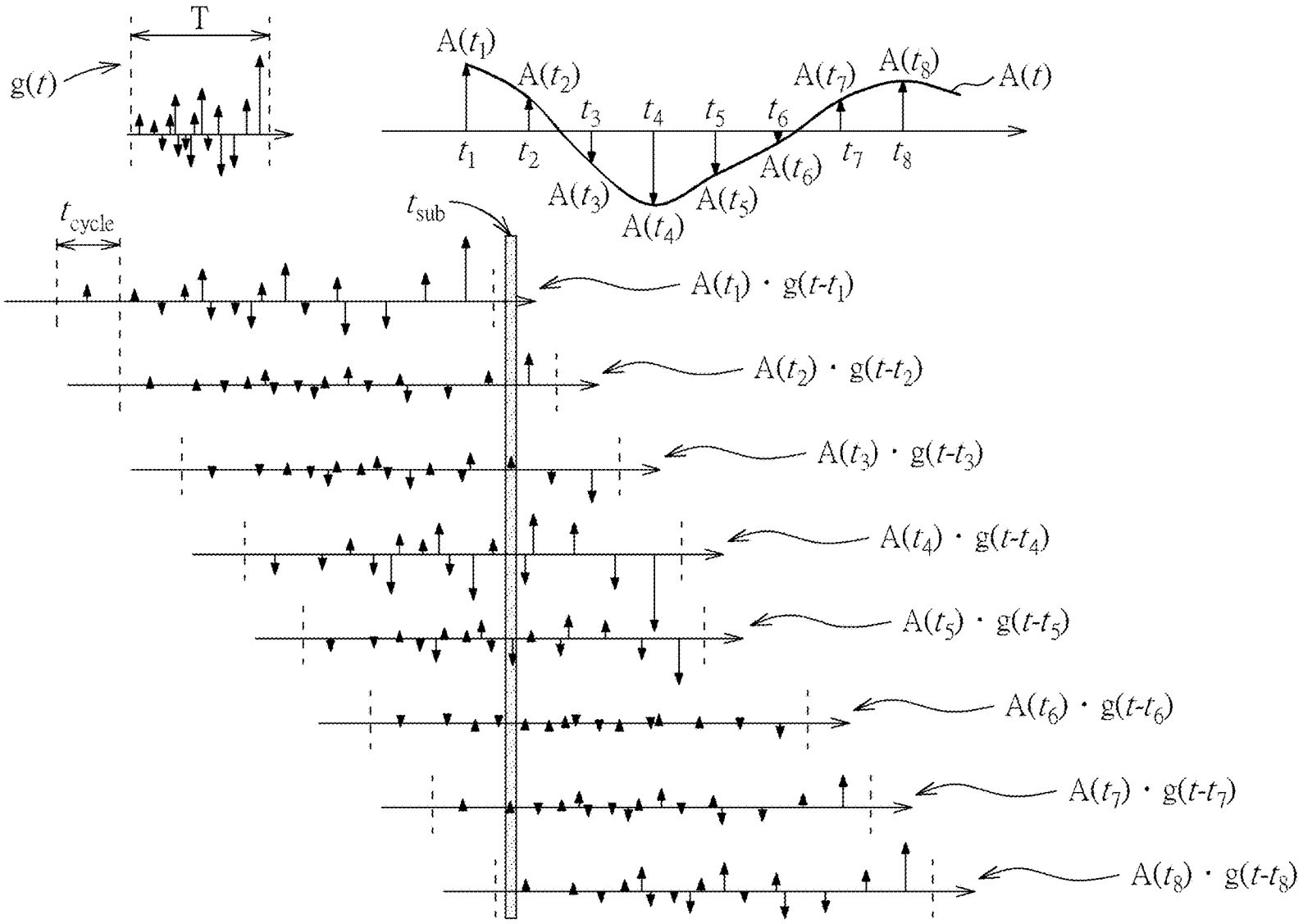
FIG. 6 illustrates waveforms of an audio input signal, a channel-shaping signal and intermediate results of convolution operation.

FIG. 6 illustrates waveforms of the audio input signal A(t) (on the top-right portion), the channel-shaping signal g(t) (on the top-left portion) and intermediate results $A(t_k)\cdot g(t-t_k)$ for k=1, . . . , 8 (on the middle to bottom portion). The driving signal d(t) outputted by the driving circuit 30 is a summation of multiple $A(t_k)\cdot g(t-t_k)$ for all k. For example, the driving signal $d(t_{sub})$ at a time instant $t_{sub}$ a summation of multiple $A(t_k)\cdot g(t_{sub}-t_k)$ for all k, i.e., $d(t_{sub})=\Sigma_k A(t_k)\cdot g(t_{sub}-t_k)$.

The SPD 120 may be a force-based SPD as Ser. No. 16/420,141, in which an electrode attached to a membrane within the force-based SPD 120 is driven by the driving signal d to produce a driving force applied on the membrane, such that the driving force is proportional to the driving signal d, but not limited thereto. The SPD may also be a position-based SPD, with or without valves.

Figure 7:
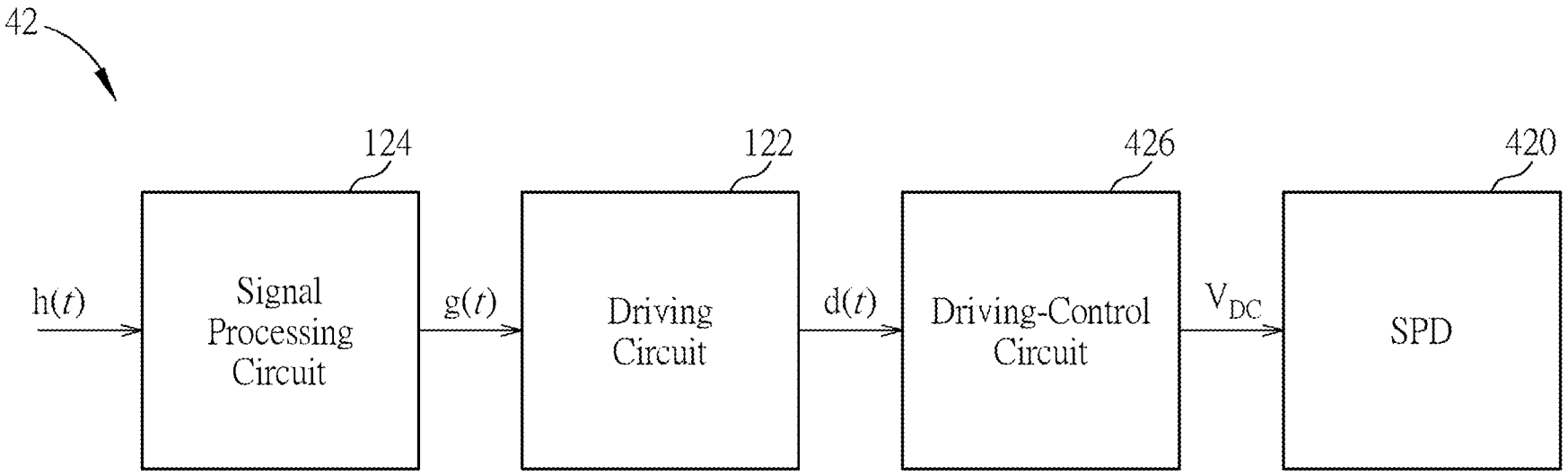
FIG. 7 is a schematic diagram of a sound producing apparatus according to an embodiment of the present application.

FIG. 7 is a schematic diagram of a sound producing apparatus 42 according to an embodiment of the present application. The sound producing apparatus 42 may also be applied in the sound producing system 10. In addition to the sound producing apparatus 12, the sound producing apparatus 42 further comprises a driving-control circuit 426 coupled to an SPD 420. The SPD 420 may be a position-based MEMS embodiments described in U.S. application Ser. No. 16/125,761 or 16/420,190. The driving-control circuit 426, coupled between the SPD 420 and the driving circuit 122, is configured to generate a driving-control signal $V_{DC}$ according to the driving signal d(t).

For the SPD 420 being the MEMS SPD with valves, as specified in Ser. No. 16/125,761, the driving-control signal $V_{DC}$ comprises valve-controlling signals and membrane driving voltages, and the driving-control circuit 426 plays a role of the control unit in Ser. No. 16/125,761.

For the SPD 420 being the MEMS SPD without valves, as specified in Ser. No. 16/420,190, the driving-control signal $V_{DC}$ comprises membrane driving voltages, and the driving-control circuit 426 plays a role of the summing module and the converting module in Ser. No. 16/420,190.

In both cases as Ser. No. 16/125,761 or 16/420,190, an electrode attached to a membrane within the position-based SPD 420 is driven by (the membrane driving voltages within) the driving-control signal $V_{DC}$, such that the membrane reaches a specific position corresponding to the driving-control signal $V_{DC}$.

Figure 8:
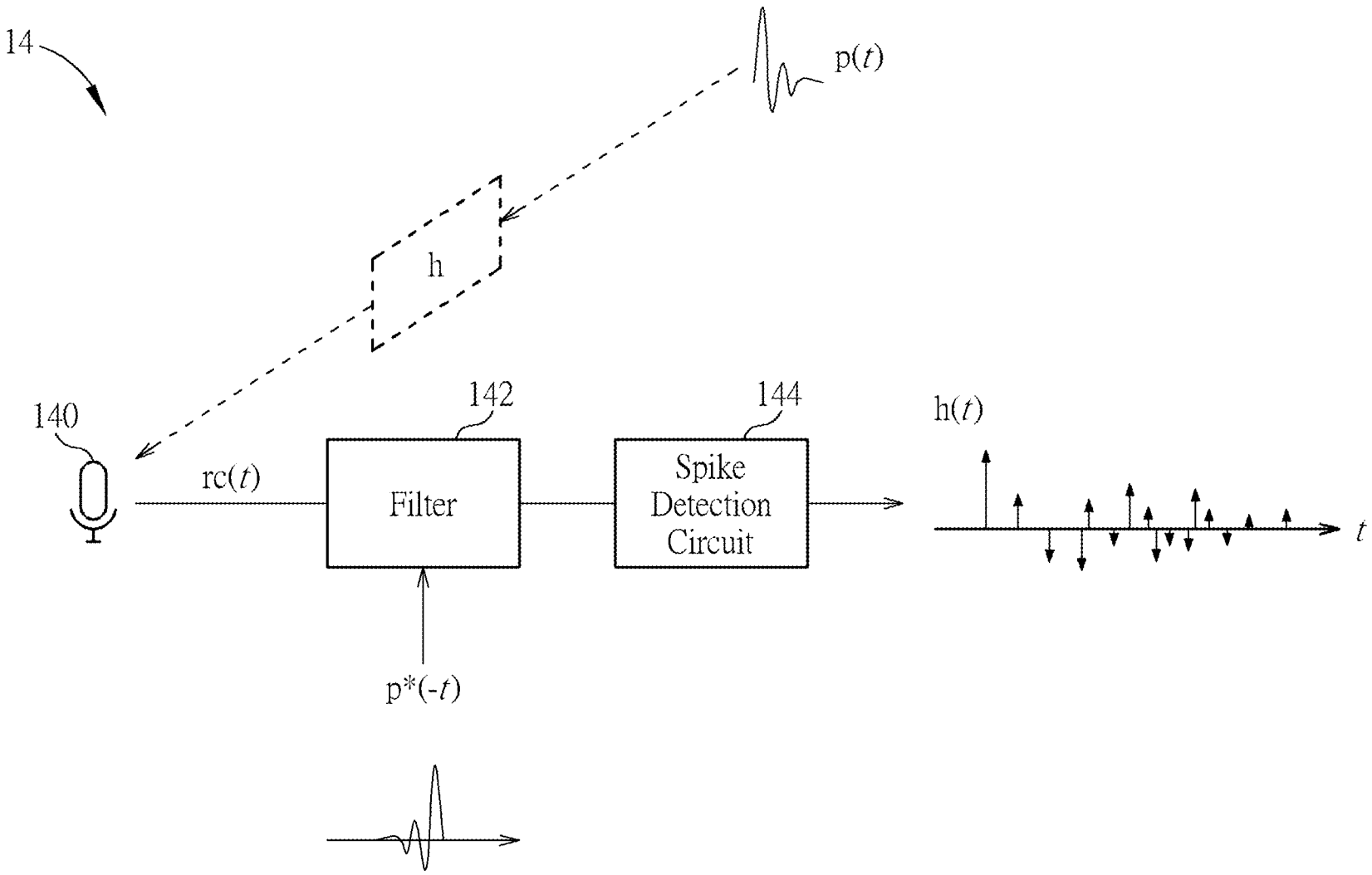
FIG. 8 is a schematic diagram of the sounding circuit according to an embodiment of the present application.

FIG. 8 is a schematic diagram of the sounding circuit 14 according to an embodiment of the present application. The sounding circuit 14 comprises a sensor 140, a filter 142 and a spike detection circuit 144. In the probing/recording phase, a probing air pulse p(t) is transmitted/emitted toward the air and through the multipath channel h, and the sensor 140 would obtain a recorded signal rc(t). The recorded signal rc(t) is corresponding to air vibration caused by the probing air pulse p(t) through the multipath channel h between the sound producing location $L_{SP}$ and the sound constructing location $L_{SC}$. The filter 142 plays a role of matched filter, which matches to the waveform of the probing air pulse p(t). In other words, an impulse response f(t) of the filter 142 reflects the feature/waveform of p(−t) or p*(−t), i.e., the impulse response f(t) of the filter 142 may be expressed as f(t)=b·p(W−t) or g(t)=b·p*(W−t), where b is a constant. In an embodiment, W may be greater than or equal to a pulse cycle or a pulse width. The filter 142 therefore outputs a filtered result fr(t) which generally has a waveform of multiple spikes. The spike detection circuit 144 performs a spike detection on the filtered result fr(t), so as to obtain information about the delay spreads $\tau_k$ and the channel paths h_k for all k, which is equivalent to obtain the entire estimated channel impulse response $h_S(t)$.

Note that, the estimated CIR $h_S(t)$ would be equal to the actual CIR h(t) under perfect channel estimation. For simplicity, the CIR between the sound producing location(s) $L_{SP}$ and the sound constructing location(s) $L_{SC}$ is referred to as the actual CIR, and the one generated by the sounding circuit and received and utilized by the signal processing circuit 124 is referred to as the estimated CIR. In the present application, sometimes the subscript $(\ )_S$ is omitted for brevity, meaning that h(t) and $h_S(t)$ can be used interchangeably.

In an embodiment, the probing air pulse p(t) may be transmitted by the SPD 120/420 disposed at the sound producing location $L_{SP}$. In this case, the sensor 140 may be disposed at the sound constructing location $L_{SC}$.

Figure 9:
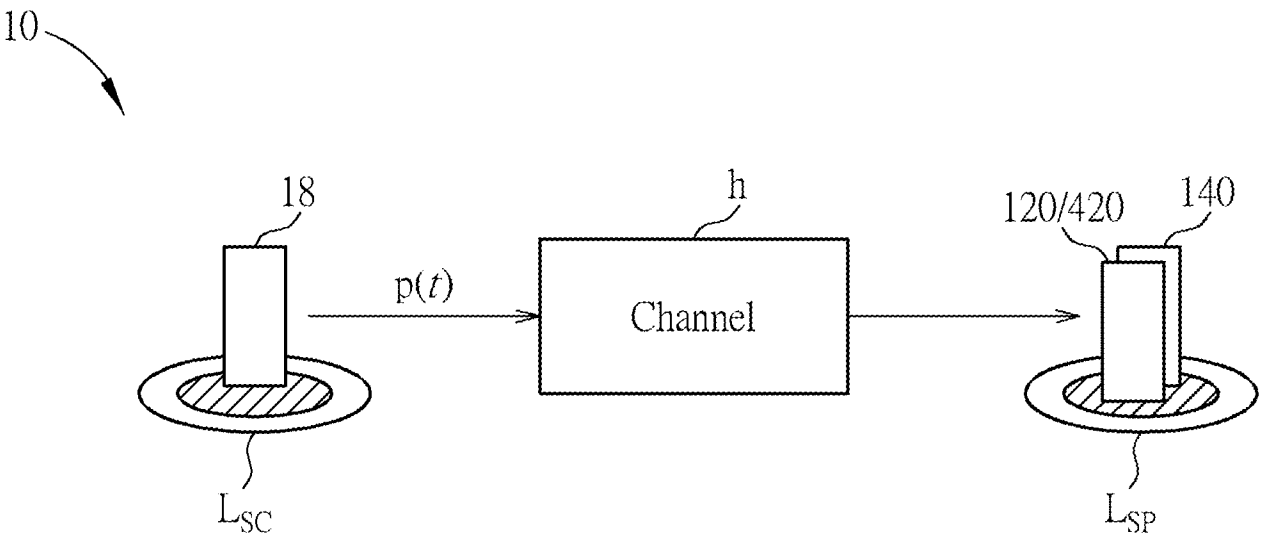
FIG. 9 illustrates a deployment of a probing circuit and a sensor 140 according to an embodiment of the present application.

In an embodiment, the sound producing system 10 may further comprise a probing circuit 18 disposed at the sound constructing location $L_{SC}$ and configured to transmit the probing air pulse p(t). In this case, the sensor 140 may be disposed at the sound producing location $L_{SP}$ and by the SPD 120/420. For example, FIG. 9 illustrates a deployment of the probing circuit 18 disposed at the sound constructing location $L_{SC}$ and the sensor 140 disposed at the sound producing location $L_{SP}$, which is also within the scope of the present application. For brevity, the internal circuits are omitted in FIG. 9.

In an embodiment, the probing/recording phase and the transmission phase may be managed by a centralized coordinator (not shown in FIG. 1). The centralized coordinator would coordinate when the sound producing system 10 should operate in the probing/recording phase and when it should operate in the transmission phase. Communications between the centralized coordinator and the components of the sound producing system 10 may be though wireline connections or wireless connections. For example, the centralized coordinator may ask the transmitter of the probing air pulse p(t), which may be the SPD 120/140 or the probing circuit 18, to transmit the probing air pulse p(t) in a first probing/recording phase. After the sounding circuit 14 produces the channel impulse response $h_S(t)$, the centralized coordinator may ask the SPD 120/140, in a second transmission phase, to produce the plurality of air pulses according to the $h_S(t)$.

In an embodiment, the probing/recording phase and the transmission phase may be managed in a distributed manner. For example, the transmitter of the probing air pulse p(t), either the SPD 120/140 or the probing circuit 18, may send a request-to-send (RTS) message to the sensor 140, which is either at the sound constructing location $L_{SC}$ or at the sound producing location $L_{SP}$. The sensor 140 may send a clear-to-send (CTS) message back to the transmitter, of the probing air pulse p(t). The CTS message can be regarded as an acknowledgement corresponding to the RTS message. After the CTS message is received by the transmitter, the transmitter sends the probing air pulse p(t). After the sounding circuit 14 produces the channel impulse response $h_S(t)$, the SPD 120/140 may be informed to produce the plurality of air pulses.

In a short remark, by utilizing the reciprocity of the multipath channel and the channel shaping signal g(t) being the time reversed counterpart/version of the estimated multipath CIR $h_S(t)$, the plurality of PAM modulated air pulses can be (re-)constructed at the sound constructing location $L_{SC}$. Due to the inherent low pass filtering effect of human hearing, the ultrasound portion of the PAM•UPA will be filtered out and the sound perceived by human will be closed to the input audio signal A(t).

In addition, unlike CDMA (or other wideband) communication systems, where the symbol duration thereof is also smaller than the channel propagation delay and RAKE receivers (or other receiver techniques) are used at the revering ends to combat against multipath effect, in the sound producing industry, it is not acceptable to deploy additional receiving device by the listener's ear to eliminate multipath effect when the listener just wants to listen to music (or, in general, audio sound) from the speaker disposed within the indoor environment. In the present application, which produces sound at pulse rate higher than maximum audible sound, effort of avoiding ICI is accomplished at the transmitting end, such as sound producing apparatus 12, via the time reversing operations performed by the signal processing circuit 124 and the convolution operation performed by the driving circuit 122.

Furthermore, due to dual spatial and temporal reciprocities, the sound producing system 10 utilizing the time-reversal would end up having both spatial focusing effect and temporal focusing effect. In addition, the more diverse is the channel-paths (environment), the better the spatial/temporal focusing effect will be. For example, the sound producing system 10 would have a better spatial/temporal focusing effect when disposed in a room full of reflective surfaces instead of in a room with bare walls, heavily carpeted floor and dense sofa.

Figure 10:
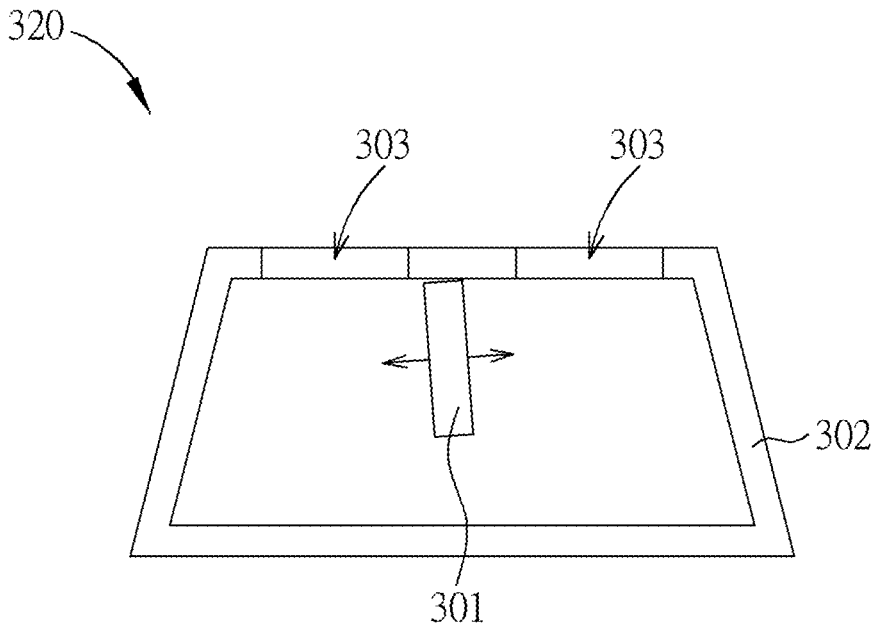
FIG. 10 is schematic diagrams of a sound producing device according to an embodiment of the present application.
Figure 11:
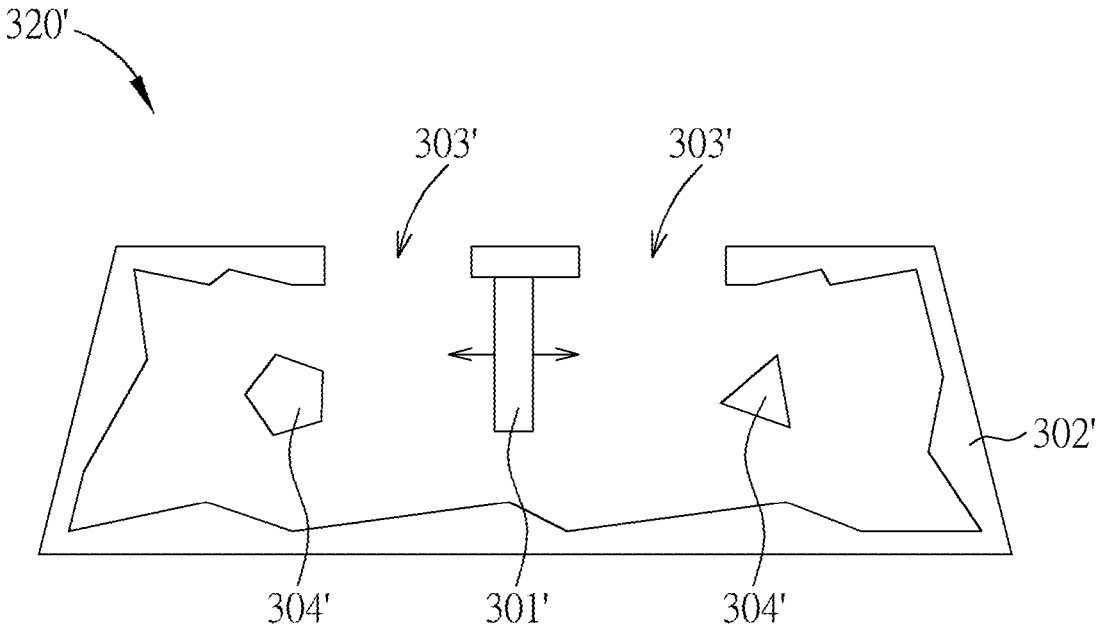
FIG. 11 is schematic diagrams of a sound producing device according to an embodiment of the present application.

In an embodiment, the channel diversity can be manipulated through the design (specifically, through the design of the enclosure) of the SPD. FIG. 10 and FIG. 11 are schematic diagrams of a SPD 320 and a SPD 320', respectively, according to embodiments of the present application. The SPD 320 comprises a pulse generating device 301 and an enclosure 302. The UPA generating device 301 may comprise a membrane and a membrane actuator, configured to vibrate/deform so as to generate the plurality of air pulses. The UPA generating device 301 is disposed, at a tilting angle and off-center, within a chamber formed by the enclosure 302. On the enclosure 302, enclosure openings 303 are formed. The SPD 320' also comprises a pulse generating device 301' and an enclosure 302' with enclosure openings 303' formed thereon, similar to the SPD 320. In addition, the SPD 320' further comprises scattering components 304', disposed within a chamber of scattering surfaces formed by the enclosure 302'. By the scattering components 304' and forming an enclosure wall of the enclosure 302' as some scattering pattern, the multipath channel experienced by the air pulses generated by the device 301' would have more diversity. Thereby, spatial/temporal focusing effect brought by the SPD 320/320' would be more significant.

Further, the plurality of air pulses, generated by the SPD of the present application, may comprise front-radiating pulses and back-radiating pulses. Different from the conventional speaker absorbing the back-radiating acoustic wave, both the front-radiating pulses and the back-radiating pulses can contribute in constructing the SPL envelope at the sound construction location $L_{SC}$, since the channel paths of the back-radiating pulses are incorporated with the CIR of the channel h as well.

Note that, the sound producing system 10 is a single-source (meaning, single source input audio signal), single-SPD and single-SCL (where SCL means sound constructing location) system. The time-reversal technique leveraging the multipath channel effect may be extended toward a multi- (or single-) source, single-SPD and multiple-SCL system.

Figure 12:
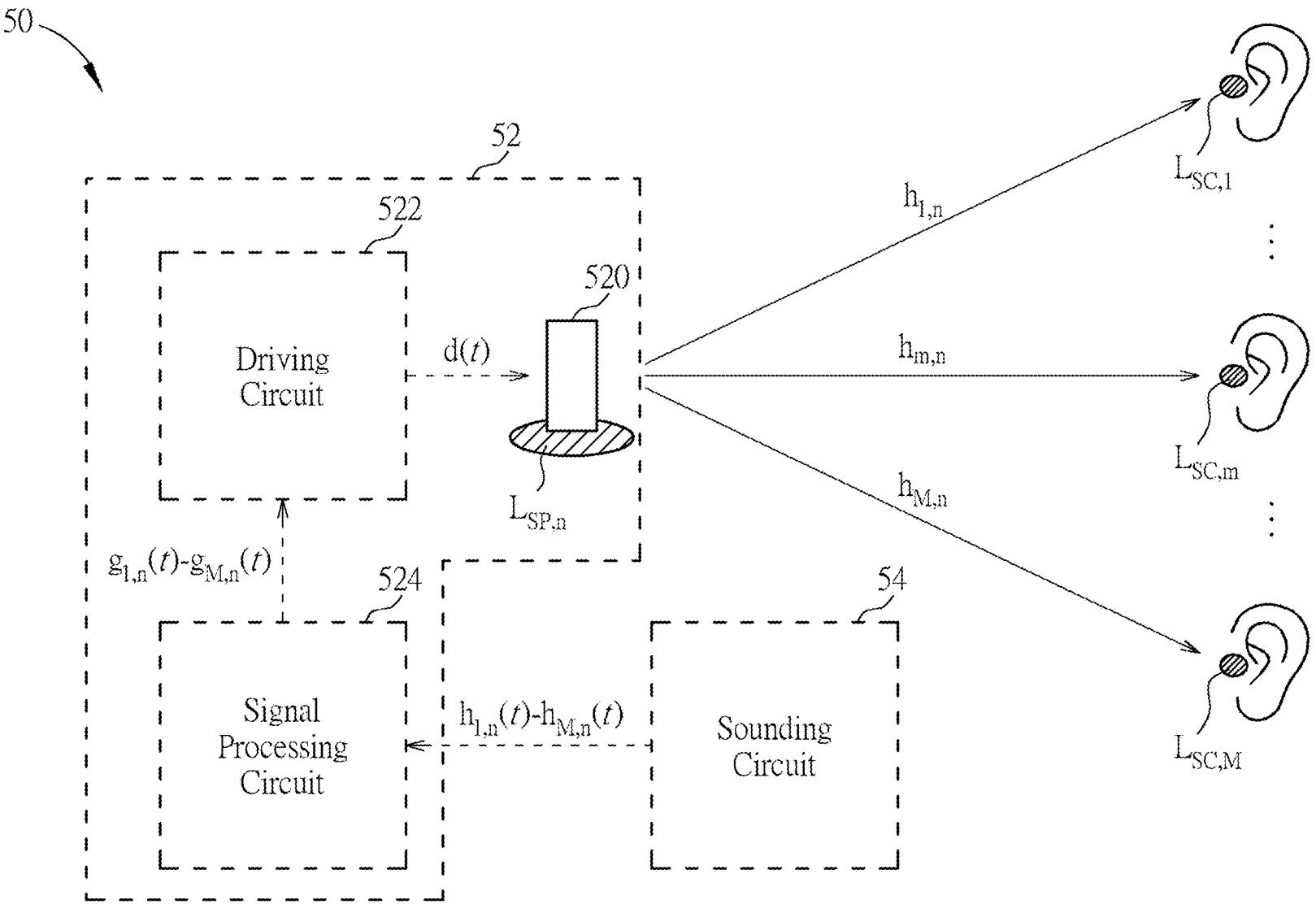
FIG. 12 is a schematic diagram of a sound producing system according to an embodiment of the present application.

FIG. 12 is a schematic diagram of a sound producing system 50 according to an embodiment of the present application. The sound producing system 50, a single-SPD and multiple-SCL system, comprises a sound producing apparatus 52 and a sounding circuit 54. The sound producing apparatus 52 comprises an SPD 520, a driving circuit 522 and a signal processing circuit 524. The SPD 520 is located at a sound producing location $L_{SP,n}$. Listeners may stay at sound constructing locations $L_{SC,1}$-$L_{SC,M}$. Symbol $h_{m,n}$ among the channels $h_{1,n}$-$h_{m,n}$ denotes the multipath channel between sound producing location $L_{SP,n}$ and sound constructing location $L_{SC,m}$. The sound constructing locations $L_{SC,1}$-$L_{SC,m}$ may represent the locations corresponding to right ears and left ears of one intended listener.

The sounding circuit 54 is configured to generate estimated channel impulse responses $h_{1,n}(t)$-$h_{m,n}(t)$ corresponding to actual multipath channels $h_{1,n}$-$h_{M,n}$. The subscript $(\ )_S$ is omitted herein for brevity. The sounding circuit 54 may comprise multiple duplicates of the sounding circuit 14, and one duplicate within the sounding circuit 54 is configured to generate one estimated channel impulse response, e.g., $h_{m,n}(t)$, of the actual multipath channels $h_{m,n}$.

The signal processing circuit 524 is configured to generate channel-shaping signals $g_{1,n}(t)$-$g_{m,n}(t)$ corresponding to the estimated channel impulse responses $h_{1,n}(t)$-$h_{m,n}(t)$, e.g., $g_{m,n}(t)=h_{m,n}*(T-t)$. The signal processing circuit 524 may comprise multiple (and parallel) duplicates of the signal processing circuit 124. One duplicate within signal processing circuit 524 is configured to generate a channel-shaping signal $g_{m,n}(t)$ corresponding to the estimated channel impulse response $h_{m,n}(t)$.

Figure 13:
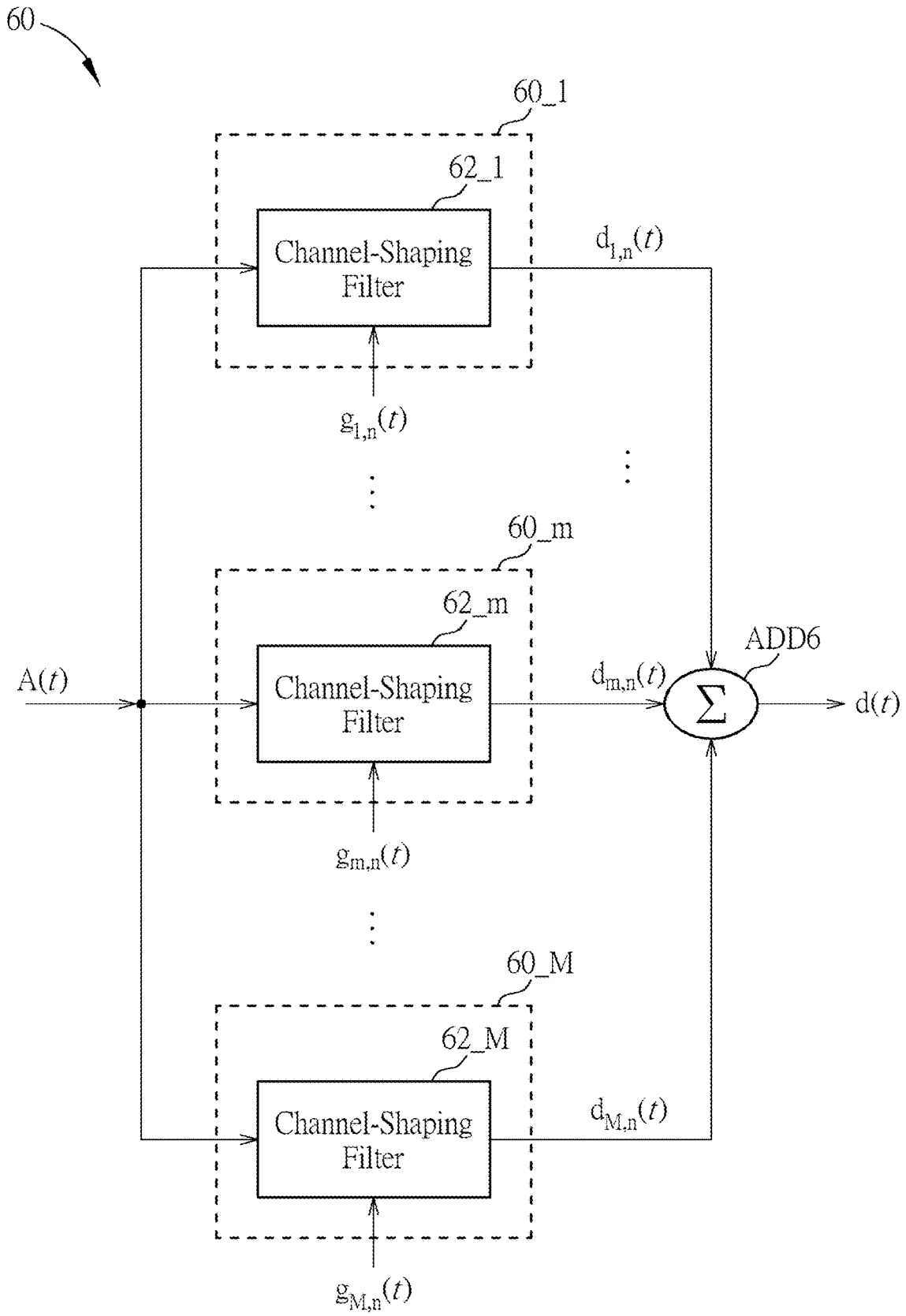
FIG. 13 is a schematic diagram of a driving circuit according to an embodiment of the present application.

FIG. 13 is a schematic diagram of a driving circuit 60 according to an embodiment of the present application. The driving circuit 60 may be used to realize the driving circuit 522. The driving circuit 60 comprises a plurality of driving sub-circuits 60_1-60_M and an adder ADD6. Each driving sub-circuit 60_*m* may be realized by the driving circuit 10, which means that the driving sub-circuit 60_*m* has the same structure as the driving circuit 10. In other words, the plurality of driving sub-circuits 60_1-60_M may comprise a plurality of channel-shaping filters 62_1-62_M, respectively. An impulse response of the channel-shaping filter 62_*m* is proportional to the channel-shaping signal $g_{m,n}(t)$. The plurality of channel-shaping filters 62_1-62_M outputs a plurality of driving sub-signals $d_{1,n}(t), \ldots, d_{M,n}(t)$, where $d_{m,n}(t)$ may be expressed as $d_{m,n}(t)=A(t)\otimes g_{m,n}(t)$. The adder ADD6 adds the driving sub-signals $d_{1,n}(t), \ldots, d_{M,n}(t)$ together and output the driving signal d(t) as $d(t)=\Sigma_m d_{m,n}(t)$. When the driving circuit 60 is applied to the sound producing apparatus 52, the sound producing system 50 would be a single-source, single-SPD and multiple-SCL system.

Figure 14:
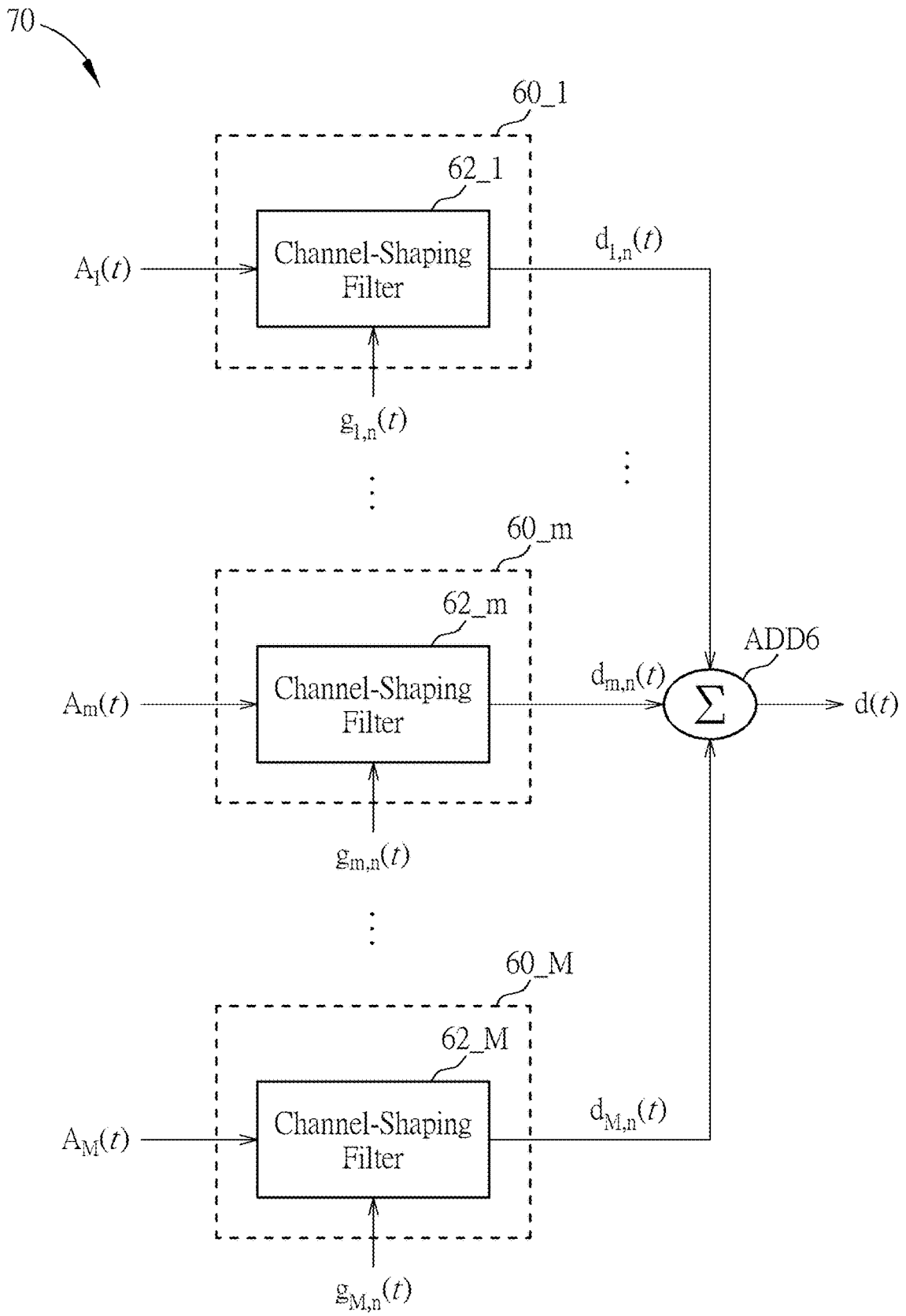
FIG. 14 is a schematic diagram of a driving circuit according to an embodiment of the present application.

FIG. 14 is a schematic diagram of a driving circuit 70 according to an embodiment of the present application. The driving circuit 70 may be used to realize the driving circuit 522. The driving circuit 70 is similar to the driving circuit 60, and thus, same components are annotated by the same notations. Different from the driving circuit 60, the driving circuit 70 receives a plurality of input audio signals $A_1(t), \ldots, A_m(t)$. The input audio signals $A_1(t), \ldots, A_m(t)$ are intended for the listeners (or ears) at sound constructing location $L_{SC,1}$-$L_{SC,M}$, respectively. The driving sub-signal $d_{m,n}(t)$ in the driving circuit 70 may be expressed as $d_{m,n}(t)=A_m(t)\otimes g_{m,n}(t)$. When the driving circuit 70 is applied to the sound producing apparatus 52, the sound producing system 50 would be a multiple-source, single-SPD and multiple-SCL system.

On the other hand, the time-reversal technique may also be extended toward a multiple-SPD and single-SCL system.

Figure 15:
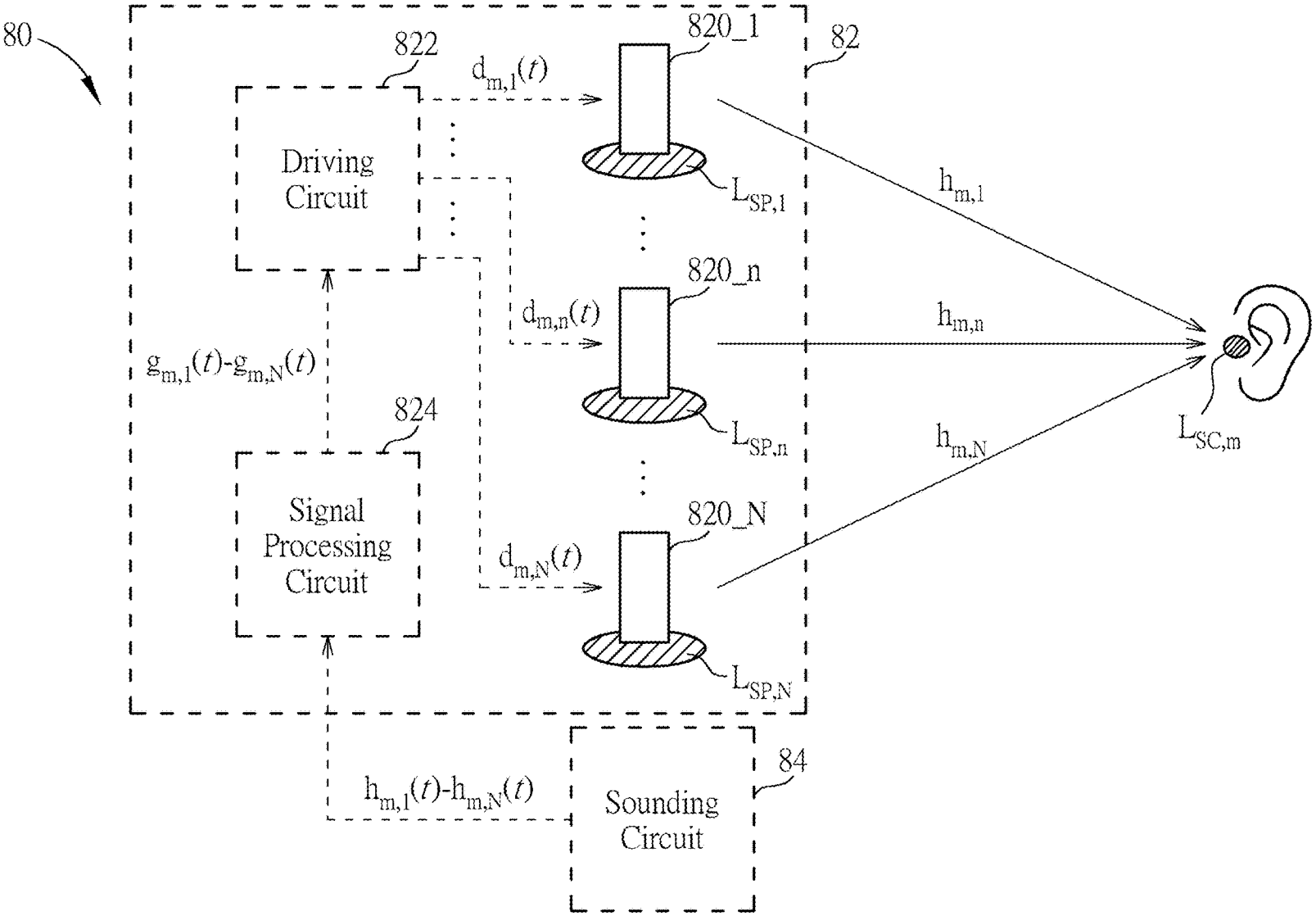
FIG. 15 is a schematic diagram of a sound producing system according to an embodiment of the present application.

FIG. 15 is a schematic diagram of a sound producing system 80 according to an embodiment of the present application. The sound producing system 80, a multiple-SPD and single-SCL system, comprises a sound producing apparatus 82 and a sounding circuit 84. The sound producing apparatus 82 comprises N sound producing devices 820_1-820_N, a driving circuit 822 and a signal processing circuit 824. Each of the sound producing sub-devices 820_1-820_N may be realized by the SPD 120/420. The sound producing sub-devices 820_1-820_N are disposed/located at sound producing locations $L_{SP,1}$-$L_{SP,N}$. A listener may stay at the sound constructing location $L_{SC,m}$. A multipath channel $h_{m,n}$ among the channels $h_{m,1}$-$h_{m,N}$ is between the sound producing location $L_{SP,n}$, and the sound constructing location $L_{SC,m}$. The sound constructing location $L_{SC,m}$ may represent the location corresponding to an ear of the intended listener.

The sounding circuit 84 is configured to generate estimated channel impulse responses $h_{m,1}(t)$-$h_{m,N}(t)$ corresponding to actual multipath channels $h_{m,1}$-$h_{m,N}$. The subscript $(\ )_S$ is omitted herein for brevity. The sounding circuit 84 may comprise multiple duplicates of the sounding circuit 14, and one duplicate within the sounding circuit 14 is configured to generate one estimated channel impulse response, e.g., $h_{m,n}(t)$, of the actual multipath channels $h_{m,n}$.

The signal processing circuit 824 is configured to generate channel-shaping signals $g_{m,1}(t)$-$g_{m,N}(t)$ corresponding to the estimated channel impulse responses $h_{m,1}(t)$-$h_{m,N}(t)$, e.g., $g_{m,n}(t)=h_{m,n}*(T-t)$. The signal processing circuit 824 may comprise N (parallel) duplicates of the signal processing circuit 124. One duplicate within signal processing circuit 824 is configured to generate one channel-shaping signal $g_{m,n}(t)$ corresponding to estimated channel impulse response $h_{m,n}(t)$.

Figure 16:
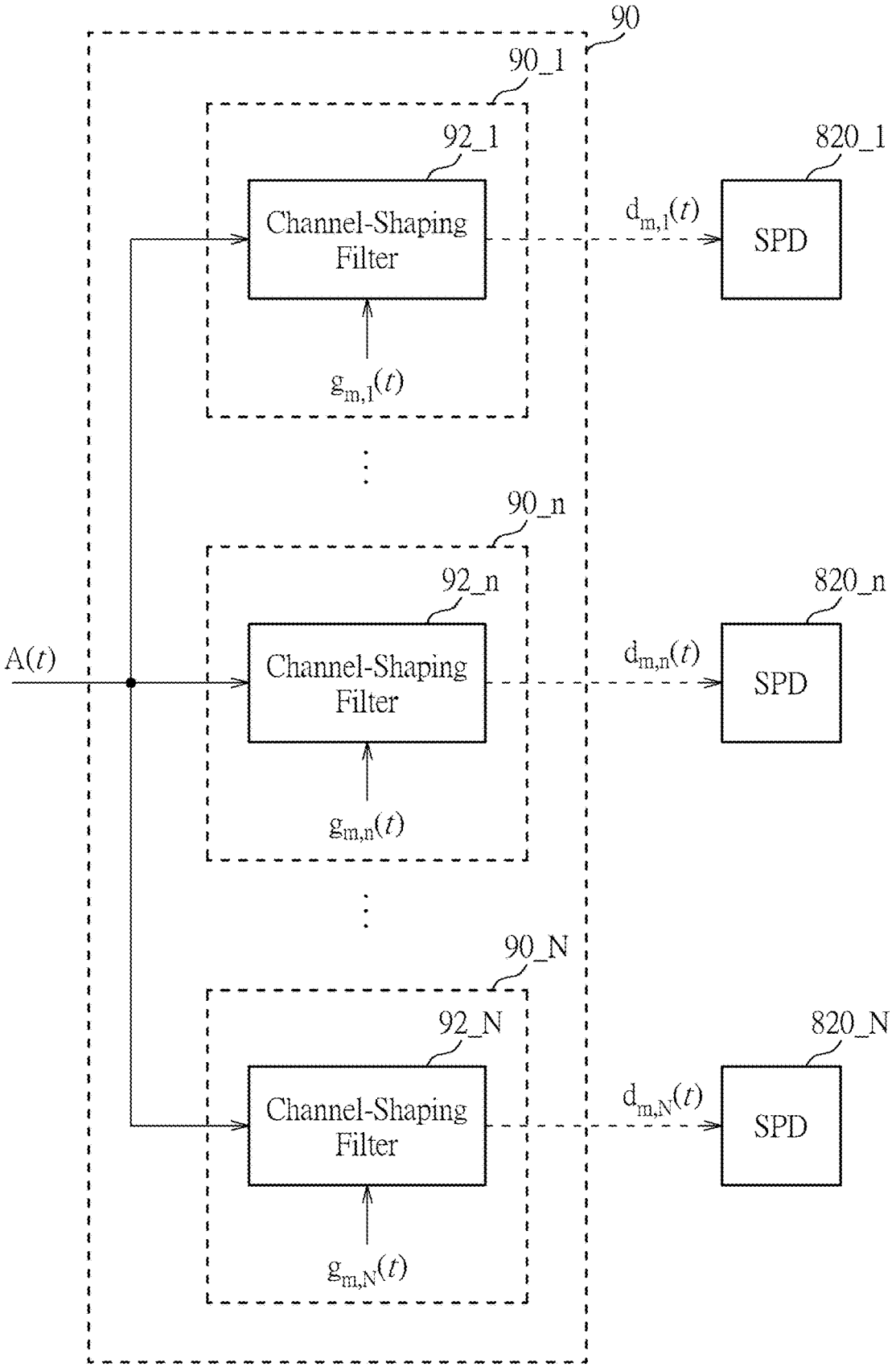
FIG. 16 is a schematic diagram of a driving circuit according to an embodiment of the present application.
Figure 17:
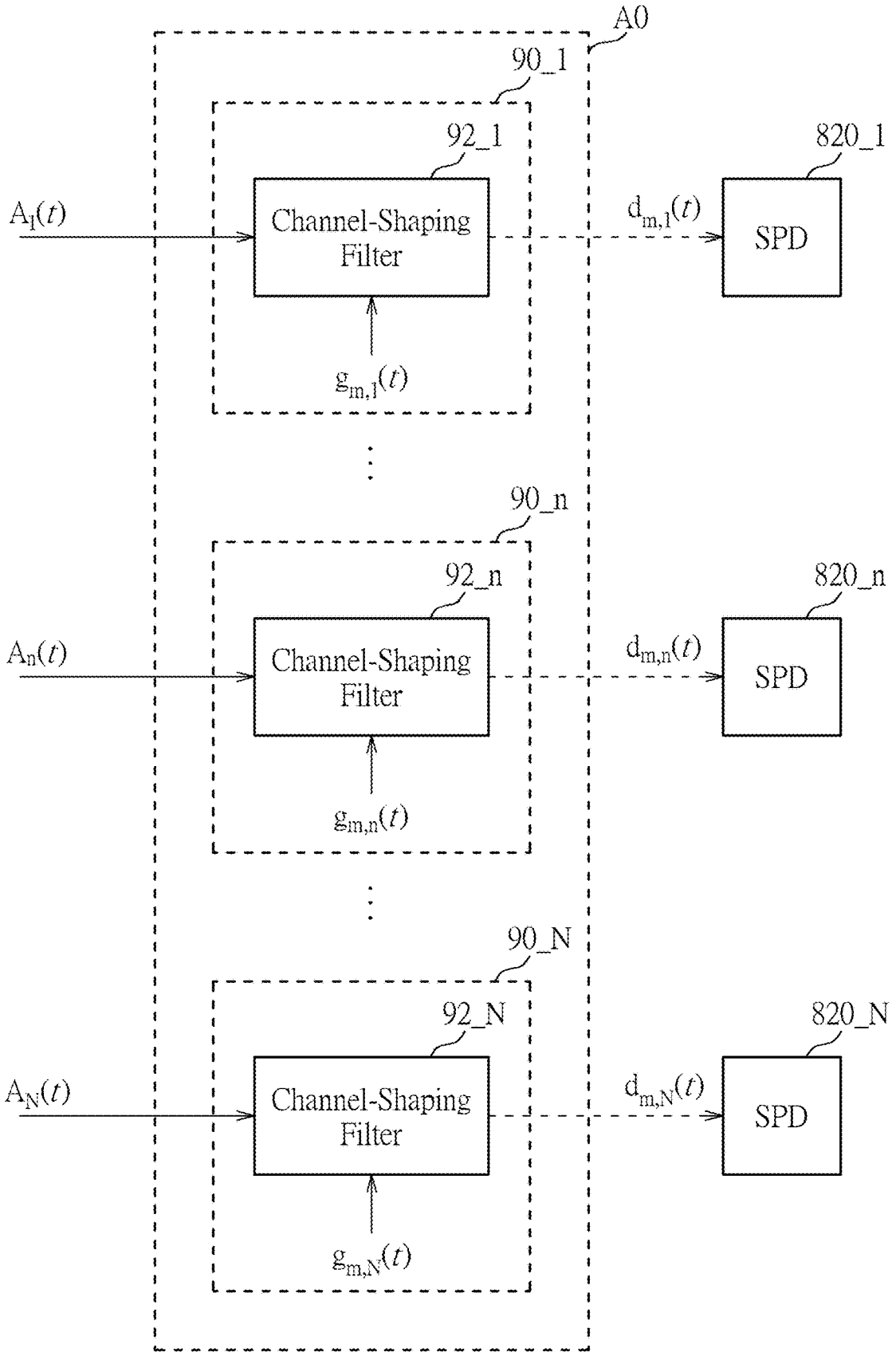
FIG. 17 is a schematic diagram of a driving circuit according to an embodiment of the present application.

FIG. 16 and FIG. 17 are schematic diagrams of a driving circuit 90 and a driving circuit A0, respectively, according to embodiments of the present application. The driving circuits 90 and A0 may be used to realize the driving circuit 822. The driving circuits 90 and A0 comprise a plurality of driving sub-circuits 90_1-90_N. Each driving sub-circuit 90_*n* may be realized by the driving circuit 10, and share the same structure as the driving circuit 10. The plurality of driving sub-circuits 90_1-90_N may comprise a plurality of channel-shaping filters 92_1-92_N, respectively. An impulse response of the channel-shaping filter 92_*n* is proportional to the channel-shaping signal $g_{m,n}(t)$. The plurality of channel-shaping filters 92_1-92_N outputs a plurality of driving sub-signals $d_{m,1}(t), \ldots, d_{m,N}(t)$, where $d_{m,n}(t)$ may be expressed as $d_{m,n}(t)=A(t)\otimes g_{m,n}(t)$.

Similar to the driving circuits 60, the sound producing apparatus 52 and the sound producing system 50, the sound producing system 80 would be a single-source, multiple-SPD and single-SCL system when the driving circuit 90 applied to the sound producing apparatus 82. For example, an multi-occupant in-vehicle audio system may use multitude SPD to improve the spatial focus and thusly allow each occupant in the vehicle to hear her/his own audio program in privacy.

Similar to the driving circuits 70, the sound producing apparatus 52 and the sound producing system 50, the sound producing system 80 would be a multiple-source, multiple-SPD and single-SCL system when the driving circuit A0 is applied to the sound producing apparatus 82, which may be a surrounding sound system disposed in, for example, a cinema, where the plurality of input audio signals $A_1(t), \ldots, A_N(t)$ may corresponding to a plurality of sound tracks.

Furthermore, those skilled in the art can easily obtain a multiple-SPD-to-multiple-SCL system, single-SPD-to-multiple-SCL system (from the sound producing system 50 in FIG. 12), multiple-SPD-to-single-SCL system (from the sound producing system 80 in FIG. 15), all either single-source or multiple-source, based on the teachings illustrated in the present application.

Note that, the "pulse interleaving" concept, proposed in U.S. application Ser. No. 16/420,184 filed by Applicant, can be applied to the multiple-SPD sound producing system of the present application.

Figure 18:
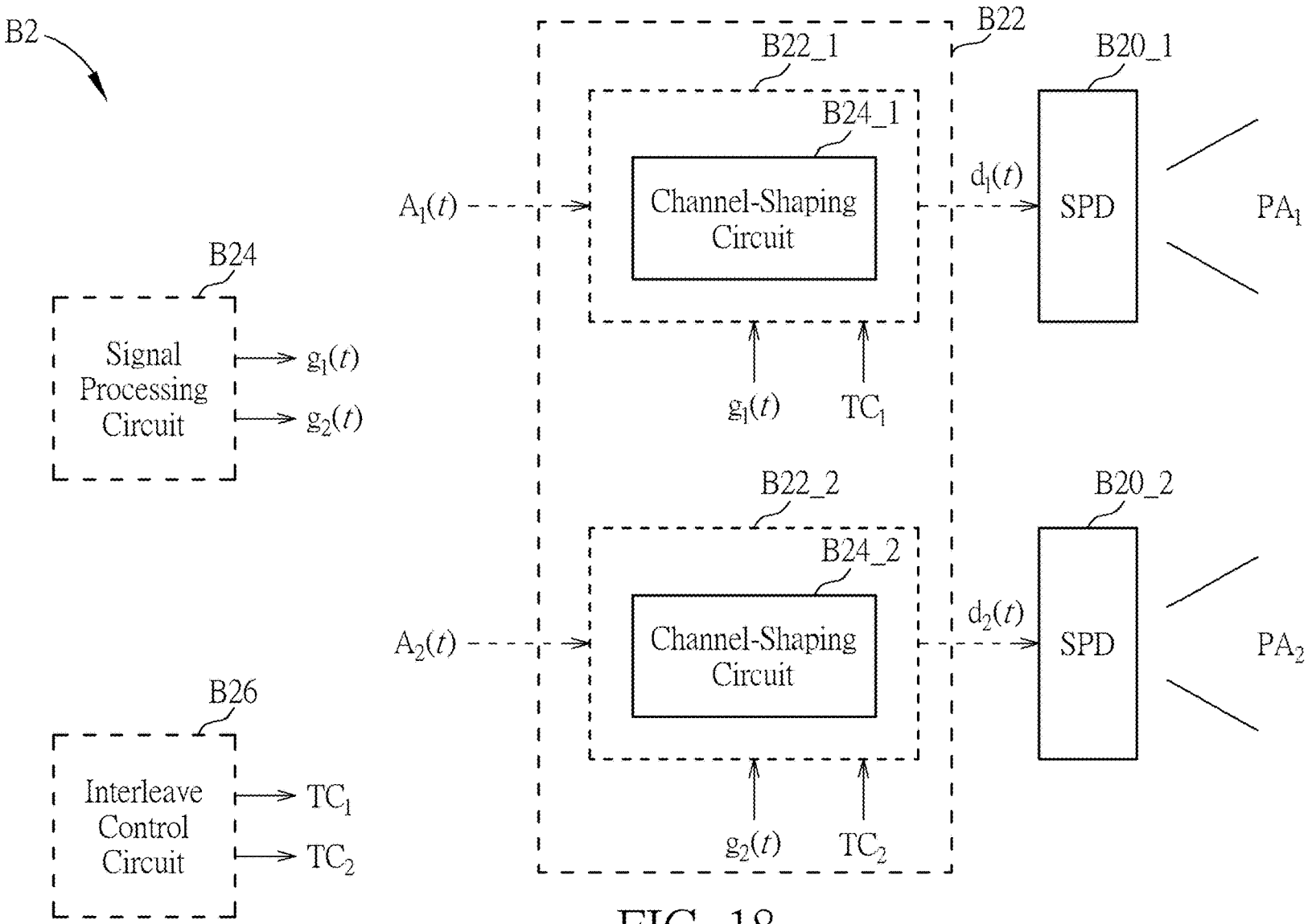
FIG. 18 is a schematic diagram of a sound producing apparatus according to an embodiment of the present application.

FIG. 18 is a schematic diagram of a "2-way pulse interleaving" sound producing apparatus B2 according to an embodiment of the present application. The sound producing apparatus B2 comprises sound producing devices (SPDs) B20_1-B20_2, a driving circuit B22, a signal processing circuit B24 and an interleave control circuit B26. The driving circuit B22 comprises driving sub-circuits B22_1, B22_2, and the driving sub-circuits B22_1, B22_2 comprise channel-shaping filters B24_1, B24_2, respectively. The driving sub-circuits B22_1, B22_2 may comprise channel-shaping filters B24_1 and B24_2, respectively. The impulse response of the channel-shaping filter B24_1 (or B24_2) is proportional to channel-shaping signal $g_1(t)$ (or $g_2(t)$), where the signal processing circuit B24 generates the channel-shaping signal $g_1(t)$ (or $g_2(t)$) corresponding to estimated CIR $h_1(t)$ (or $h_2(t)$), i.e., $g_1(t)=h_i*(T-t)$, for i=1,2. The estimated CIR $h_1(t)$ (or $h_2(t)$) corresponds to multipath channel $h_1$ (or $h_2$) between the SPD B20_1 (or B20_2) and a specific sound constructing location.

Figure 19:
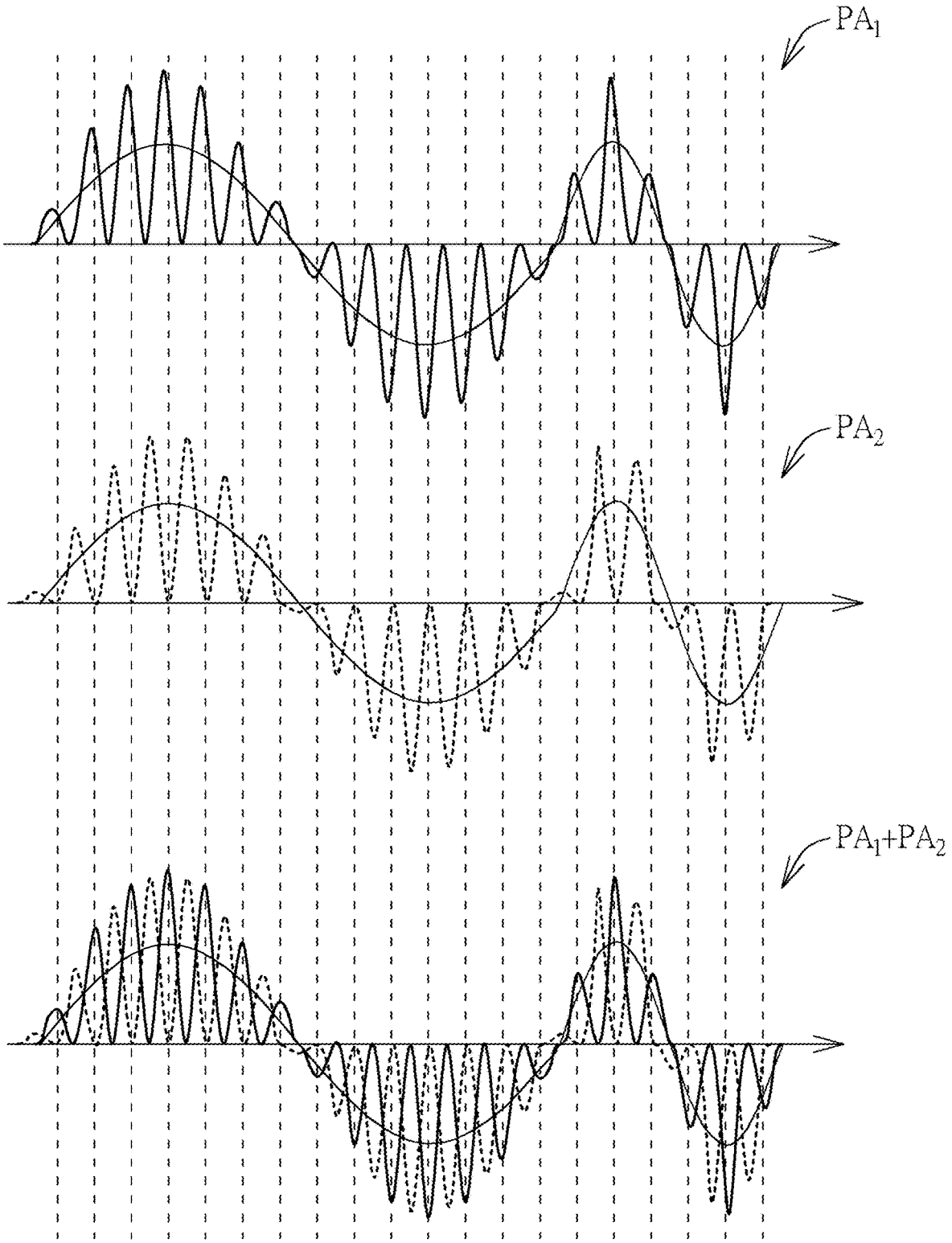
FIG. 19 illustrates waveforms of a plurality of air pulse arrays.

Operations of the SPDs B20_1, B20_2 and the driving circuit B22 are similar to which of the SPDs 820_1, 820_2 and the driving circuit 90/A0, and not narrated herein for brevity. Different from the embodiments corresponding to FIGS. 15-17, the driving sub-circuits B22_1 and B22_2 are further controlled by interleave control signals $TC_1$ and $TC_2$, such that the SPDs 820_1, 820_2 are driven by a driving sub-signal $d_1(t)$, $d_2(t)$ to produce air pulse arrays $PA_1$, $PA_2$ and, as illustrated in FIG. 19, air pulse arrays $PA_1$ and $PA_2$ are mutually interleaved, where each pulse array herein comprises a plurality of air pulses, and the interleave control signal $TC_1$, $TC_2$ is generated by the interleave control circuit B26.

Driving sub-signals $d_1(t)$, $d_2(t)$ are generated according to $A_1(t)$, $A_2(t)$ which are two versions of input audio signal A sampled at 2-way interleaved time intervals. Illustrated in FIG. 9 is the interleaved air pulse arrays $PA_1$, $PA_2$ at the intended sound construction position, their relationship to signal A (represented by the slow moving curve) and the combined $PA_1+PA_2$. As can be observed in FIG. 19, the resolution of the 2-way pulse interleaved sound producing apparatus B2 is two times of the resolution of $PA_1$ and $PA_2$. The scheme illustrated in FIG. 18-19 can be generalized into a N-way pulse interleaving sound producing system by applying the same principles taught above. In general, an N-way pulse interleaving embodiment of the present application will have N times the resolution of non-interleaved embodiments.

Figure 20:
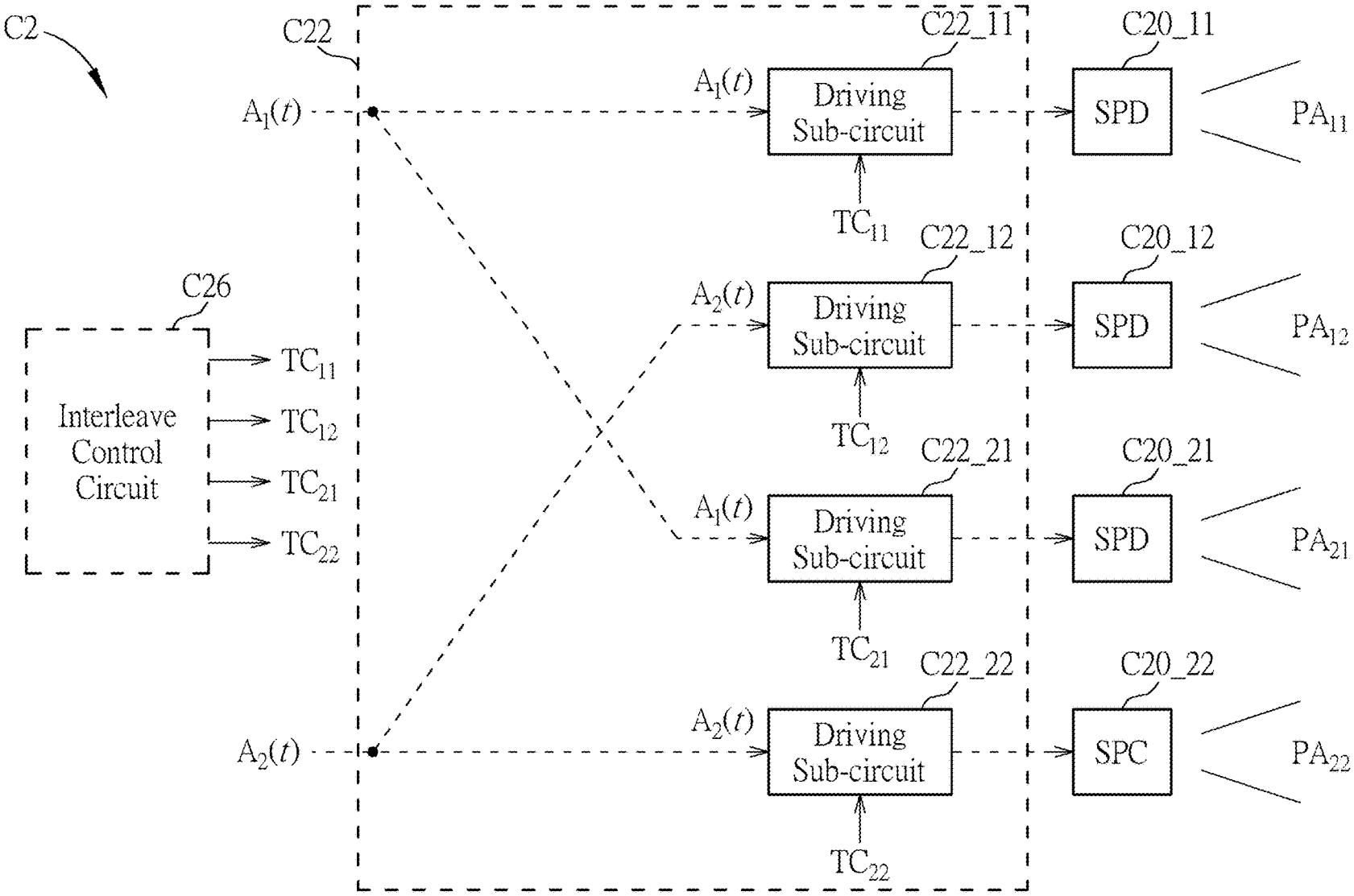
FIG. 20 is a schematic diagram of a sound producing apparatus according to an embodiment of the present application.

FIG. 20 is a schematic diagram of a "stereo 2-way pulse interleaving" sound producing apparatus C2 according to of the present application. The sound producing apparatus C2 comprises SPDs C20_11-C20_22, a driving circuit C22 and an interleave control circuit C26, where signal processing circuit with the sound producing apparatus C2 is omitted for brevity. The driving circuit C22 comprises driving sub-circuits C22_11-C22_22 (where channel-shaping filters within the driving sub-circuits C22_11-C22_22 are omitted for brevity), controlled by interleave control signals $TC_{11}$-$TC_{22}$ generated by the interleave control circuit C26, such that air pulse arrays $PA_{11}$-$PA_{22}$ produced by the SPDs C20_11-C20_22 are mutually interleaved.

The plurality of air pulses and the air pulse array produced by the SPD of the present application would inherit the air pulse characteristics of U.S. application Ser. Nos. 16/125,761, 16/420,141, 16/420,190 and 16/420,184, in which the air pulse rate is higher than a maximum human audible frequency, and each one of the plurality of air pulses generated by the SPD of the present application would have non-zero offset in terms of sound pressure level (SPL), where the non-zero offset is a deviation from a zero SPL. In addition, the plurality of air pulses generated by the SPD of the present application is aperiodic over a plurality of pulse cycles. Details of the "non-zero SPL offset" and the "aperiodicity" properties may be referred to U.S. application Ser. No. 16/125,761, which are not narrated herein for brevity.

In summary, the present application exploits the TR transmission scheme, by using channel sounding circuit and signal processing circuit, in sound producing apparatus/system to leverage the multipath effect, so as to construct audio sound at sound constructing location which is a distance away from sound producing device. Variation based on the TR scheme of multiple-source, multiple-SPD and multiple-SCL systems are provided. Pulse interleaving is also applied in the multiple-SPD systems.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sound producing apparatus, comprising:

a sound producing device, disposed at a sound producing location, configured to produce a plurality of air pulses according to a driving signal;

a driving circuit, receiving an input audio signal and a channel-shaping signal, configured to generate the driving signal according to the input audio signal and the channel-shaping signal, wherein the channel-shaping signal is related to a channel impulse response of a channel between the sound producing location and a sound constructing location; and a signal processing circuit, configured to generate the channel-shaping signal according to the channel impulse response;

wherein an air pulse rate of the plurality of air pulses is higher than a maximum human audible frequency;

wherein the plurality of air pulses produces a non-zero offset in terms of sound pressure level, and the non-zero offset is a deviation from a zero sound pressure level.

2. The sound producing apparatus of claim 1, wherein the signal processing circuit generates the channel-shaping signal to be proportional to a time-reversed or a time-reversed-and-conjugated counterpart of the channel impulse response of the channel between the sound producing location and the sound constructing location.

3. The sound producing apparatus of claim 1, wherein the driving signal is coupled to a sounding circuit, and the sounding circuit is configured to generate the channel impulse response of the channel between the sound producing location and the sound constructing location.

4. The sound producing apparatus of claim 1, wherein the driving circuit is further configured to perform a convolution operation on the input audio signal and the channel-shaping signal.

5. The sound producing apparatus of claim 1, wherein the driving circuit comprises:

a channel-shaping filter;

wherein an impulse response of the channel-shaping filter is proportional to the channel-shaping signal.

6. The sound producing apparatus of claim 5, wherein the driving circuit further comprises:

a sampling circuit, configured to perform a sampling operation to generate a plurality of samples of the audio input signal;

wherein the channel-shaping filter is coupled to the sampling circuit to receive the plurality of samples of the audio input signal, such that channel-shaping filter outputs the driving signal as a convolution of the plurality of samples of the audio input signal and the channel-shaping signal.

7. The sound producing apparatus of claim 1, further comprising:

a driving-control circuit, coupled between the sound producing device and the driving circuit, configured to generate a driving-control signal according to the driving signal;

wherein the sound producing device produces the plurality of air pulses according to the driving-control signal.

8. The sound producing apparatus of claim 7, wherein an electrode attached to a membrane within the sound producing device is driven by the driving-control signal, such that the membrane reaches a specific position corresponding to the driving-control signal.

9. The sound producing apparatus of claim 1, wherein an electrode attached to a membrane within the sound producing device is driven by the driving signal to produce a driving force applied on the membrane, such that the driving force is proportional to the driving signal.

10. The sound producing apparatus of claim 1, wherein the sound producing device comprises:

a pulse generating device; and an enclosure, wherein an enclosure opening is formed on the enclosure.

11. The sound producing apparatus of claim 10, wherein the sound producing device further comprises:

a scattering component, disposed within a chamber formed by the enclosure.

12. The sound producing apparatus of claim 10, wherein an enclosure wall of the enclosure is formed as a scattering pattern.

13. The sound producing apparatus of claim 1, wherein the driving circuit comprises:

a plurality of driving sub-circuits, configured to receive the input audio signal and a plurality of channel-shaping signals, and generate a plurality of driving sub-signals according to the input audio signal and the plurality of channel-shaping signals, wherein the plurality of channel-shaping signals is related to a plurality of channels between the sound producing location and a plurality of sound constructing locations; and an adder, configured to perform a summing operation over the plurality of driving sub-signals and output the driving signal, wherein the driving signal is a summation of the plurality of driving sub-signals;

wherein the sound producing device produces the plurality of air pulses according to the driving signal;

wherein a first driving sub-circuit among the plurality of driving sub-circuit comprises:

a channel-shaping filter, configured to output a first driving sub-signal among the plurality of driving sub-signals;

wherein an impulse response of the channel-shaping filter is proportional to a first channel-shaping signal among the plurality of channel-shaping signals.

14. The sound producing apparatus of claim 1, wherein the driving circuit comprises:

a plurality of driving sub-circuit, receiving a plurality of input audio signals and a plurality of channel-shaping signals, configured to generate a plurality of driving sub-signals according to the plurality of input audio signals and the plurality of channel-shaping signals, wherein the plurality of channel-shaping signals is related to a plurality of channels between the sound producing location and a plurality of sound constructing locations; and an adder, configured to perform a summing operation over the plurality of driving sub-signals and output the driving signal, wherein the driving signal is a summation of the plurality of driving sub-signals;

wherein the sound producing device produces the plurality of air pulses according to the driving signal;

wherein a first driving sub-circuit among the plurality of driving sub-circuit comprises:

a channel-shaping filter, configured to output a first driving sub-signal among the plurality of driving sub-signals;

wherein an impulse response of the channel-shaping filter is proportional to a first channel-shaping signal among the plurality of channel-shaping signals.

15. The sound producing apparatus of claim 1, further comprising a plurality of sound producing devices disposed at a plurality of sound producing locations, wherein the driving circuit comprises:

a plurality of driving sub-circuit, receiving the input audio signal and a plurality of channel-shaping signals, configured to generate a plurality of driving sub-signals according to the input audio signal and the plurality of channel-shaping signals, wherein the plurality of channel-shaping signals is related to a plurality of channels between the plurality of sound producing locations and the sound constructing location;

wherein the plurality of sound producing devices produces air pulses according to a plurality of driving sub-signals;

wherein a first driving sub-circuit among the plurality of driving sub-circuit comprises:

a channel-shaping filter, configured to output a first driving sub-signal among the plurality of driving sub-signals;

wherein an impulse response of the channel-shaping filter is proportional to a first channel-shaping signal among the plurality of channel-shaping signals.

16. The sound producing apparatus of claim 1, further comprising:

a plurality of sound producing devices and an interleave control circuit;

wherein the interleave control circuit is configured to generate a plurality of interleave control signal;

wherein the driving circuit comprises a plurality of driving sub-circuit to drive the plurality of sound producing devices;

wherein the plurality of driving sub-circuit is controlled by the plurality of interleave control signal, such that the plurality of sound producing devices generates a plurality of air pulse arrays;

wherein the plurality of air pulse arrays are mutually interleaved.

17. A sound producing system, comprising:

a sound producing apparatus, comprising:

a sound producing device, disposed at a sound producing location, configured to produce a plurality of air pulses according to a driving signal;

a driving circuit, receiving an input audio signal and a channel-shaping signal, configured to generate the driving signal according to the input audio signal and the channel-shaping signal, wherein the channel-shaping signal is related to a channel impulse response of a channel between the sound producing location and a sound constructing location; and a signal processing circuit, configured to generate the channel-shaping signal according to the channel impulse response; and a sounding circuit, configured to generate the channel impulse response of the channel between the sound producing location and the sound constructing location;

wherein an air pulse rate of the plurality of air pulses is higher than a maximum human audible frequency;

wherein the plurality of air pulses produces a non-zero offset in terms of sound pressure level, and the non-zero offset is a deviation from a zero sound pressure level.

18. The sound producing system of claim 17, wherein the sounding circuit comprises:

a sensor, disposed at the sound constructing location, configured to generate a recorded signal from air, wherein the recorded signal is in response to a probing air pulse transmitted to experience the channel between the sound producing location and the sound constructing location;

a first filter, coupled to the sensor, configured to output a first filtered result according to the recorded signal, wherein a first impulse response of the first filter is related to the probing air pulse; and a spike detection circuit, coupled to the first filter to receive the first filtered result, configured to obtain the channel impulse response according to the first filtered result.

19. The sound producing system of claim 18, wherein the sensor is disposed at the sound constructing location, and the probing air pulse is transmitted from the sound producing location.

20. The sound producing system of claim 17, wherein the driving circuit comprises:

a plurality of driving sub-circuits, configured to receive the input audio signal and a plurality of channel-shaping signals, and generate a plurality of driving sub-signals according to the input audio signal and the plurality of channel-shaping signals, wherein the plurality of channel-shaping signals is related to a plurality of channels between the sound producing location and a plurality of sound constructing locations; and an adder, configured to perform a summing operation over the plurality of driving sub-signals and output the driving signal, wherein the driving signal is a summation of the plurality of driving sub-signals;

wherein the sound producing device produces the plurality of air pulses according to the driving signal;

wherein a first driving sub-circuit among the plurality of driving sub-circuit comprises:

a channel-shaping filter, configured to output a first driving sub-signal among the plurality of driving sub-signals;

wherein an impulse response of the channel-shaping filter is proportional to a first channel-shaping signal among the plurality of channel-shaping signals.

21. The sound producing system of claim 17, wherein the driving circuit comprises:

a plurality of driving sub-circuit, receiving a plurality of input audio signals and a plurality of channel-shaping signals, configured to generate a plurality of driving sub-signals according to the plurality of input audio signals and the plurality of channel-shaping signals, wherein the plurality of channel-shaping signals is related to a plurality of channels between the sound producing location and a plurality of sound constructing locations; and an adder, configured to perform a summing operation over the plurality of driving sub-signals and output the driving signal, wherein the driving signal is a summation of the plurality of driving sub-signals;

wherein the sound producing device produces the plurality of air pulses according to the driving signal;

wherein a first driving sub-circuit among the plurality of driving sub-circuit comprises:

a channel-shaping filter, configured to output a first driving sub-signal among the plurality of driving sub-signals;

wherein an impulse response of the channel-shaping filter is proportional to a first channel-shaping signal among the plurality of channel-shaping signals.

22. The sound producing system of claim 17, wherein the sound producing apparatus further comprises a plurality of sound producing devices disposed at a plurality of sound producing locations, and the driving circuit comprises:

a plurality of driving sub-circuit, receiving the input audio signal and a plurality of channel-shaping signals, configured to generate a plurality of driving sub-signals according to the input audio signal and the plurality of channel-shaping signals, wherein the plurality of channel-shaping signals is related to a plurality of channels between the plurality of sound producing locations and the sound constructing location;

wherein the plurality of sound producing devices produces air pulses according to a plurality of driving sub-signals;

wherein a first driving sub-circuit among the plurality of driving sub-circuit comprises:

a channel-shaping filter, configured to output a first driving sub-signal among the plurality of driving sub-signals;

wherein an impulse response of the channel-shaping filter is proportional to a first channel-shaping signal among the plurality of channel-shaping signals.

23. The sound producing system of claim 17, wherein the sound producing apparatus further comprises:

a plurality of sound producing devices and an interleave control circuit;

wherein the interleave control circuit is configured to generate a plurality of interleave control signal;

wherein the driving circuit comprises a plurality of driving sub-circuit to drive the plurality of sound producing devices;

wherein the plurality of driving sub-circuit is controlled by the plurality of interleave control signal, such that the plurality of sound producing devices generates a plurality of air pulse arrays;

wherein the plurality of air pulse arrays are mutually interleaved.

24. A sound producing apparatus, comprising:

a sound producing device, disposed at a sound producing location, configured to produce a plurality of air pulses according to a driving signal;

a driving circuit, configured to generate the driving signal according to an input audio signal and a channel impulse response of a channel between the sound producing location and a sound constructing location;

wherein the plurality of air pulses is emitted from the sound producing location, propagates through an environment, such that a sound pressure level envelope corresponding to the input audio signal is constructed at the sound construction location;

wherein the sound construction location is different from the sound production location.

25. The sound producing apparatus of claim 24, wherein the air pulse rate of the plurality of air pulses is higher than a maximum human audible frequency.

26. The sound producing apparatus of claim 24, wherein the plurality of air pulses produces a non-zero offset in terms of sound pressure level, and the non-zero offset is a deviation from a zero sound pressure level.

27. The sound producing apparatus of claim 24, wherein the driving signal is produced according to the input audio signal and the channel-shaping signal, and the channel-shaping signal is related to the channel impulse response.

28. The sound producing apparatus of claim 27, wherein the channel-shaping signal is generated by signal processing circuit according to the channel impulse response.

29. The sound producing apparatus of claim 24, wherein the sound producing apparatus produces both front-radiating pulses and back-radiating pulses; both the front-radiating pulses and the back-radiating pulses contribute in constructing the SPL envelope.

* * * * *